US005297462A

United States Patent [19]

Creaden

[11] Patent Number: 5,297,462

[45] Date of Patent: Mar. 29, 1994

[54] SLOTTER WHEEL MECHANISM HAVING DYNAMICALLY RETRACTABLE SLOTTER BLADES

[75] Inventor: David E. Creaden, Lawrence, Kans.

[73] Assignee: The Lawrence Paper Company, Lawrence, Kans.

[21] Appl. No.: 916,610

[22] Filed: Jul. 22, 1992

Related U.S. Application Data

[63] Continuation-in-part of Ser. No. 782,523, Oct. 25, 1991, abandoned.

[51] Int. Cl.[5] ..... B26D 1/12; B31B 1/14

[52] U.S. Cl. ..... 83/305; 83/332; 83/345; 83/508.1; 83/563; 83/678; 493/370; 493/471; 493/475

[58] Field of Search ..... 83/305, 332, 345, 346, 83/482, 508.1, 528, 563, 677, 678; 493/365, 367, 370, 471, 475

[56] References Cited

U.S. PATENT DOCUMENTS

| | | | |
|---|---|---|---|
| 1,802,554 | 4/1931 | Hahn | 83/305 X |
| 2,491,871 | 12/1949 | Morgan | 83/305 |
| 3,008,366 | 11/1961 | Taylor, Jr. | 83/346 |
| 3,855,890 | 12/1974 | Lynch et al. | 83/678 X |
| 4,712,461 | 12/1987 | Rasmussen | 83/334 |
| 4,742,741 | 5/1988 | Hallberg et al. | 83/305 X |
| 4,805,502 | 2/1989 | Ishigure | 83/332 |

*Primary Examiner*—Eugenia Jones
*Attorney, Agent, or Firm*—Hovey, Williams, Timmons & Collins

[57] ABSTRACT

An improved slotter wheel mechanism designed for use in the formation of box blanks is provided which includes a rotatable wheel assembly supporting one or more slotter blades; the blades are coupled to the wheel by means permitting shifting of the blades during rotation of the wheel assembly between an extended slotting position and a retracted blank-clearing position. In one embodiment, the blades are supported on respective blade holders each having a cam secured thereto. A stationary yoke plate adjacent the wheel assembly supports a pair of inner and outer cam grooves adapted to receive the blade holder cams. A shiftable, grooved cam switch is operatively interposed in the cam arrangement for selectively directing the blade holder cams into one or the other of the cam grooves, thereby camming the associated blade holders and blades between their respective positions. If desired, use can be made of a sectionalized slotting blade assembly having blade sections interconnected by means of a pivotal, intermediate blade section. In another embodiment, a cam assembly presents a shiftable cam portion which can be shifted to select a blade extended or retracted position and further includes a locking link assembly for locking the blade holder and thereby the blades in the selected position during rotation through the portion of the arc of travel.

16 Claims, 16 Drawing Sheets

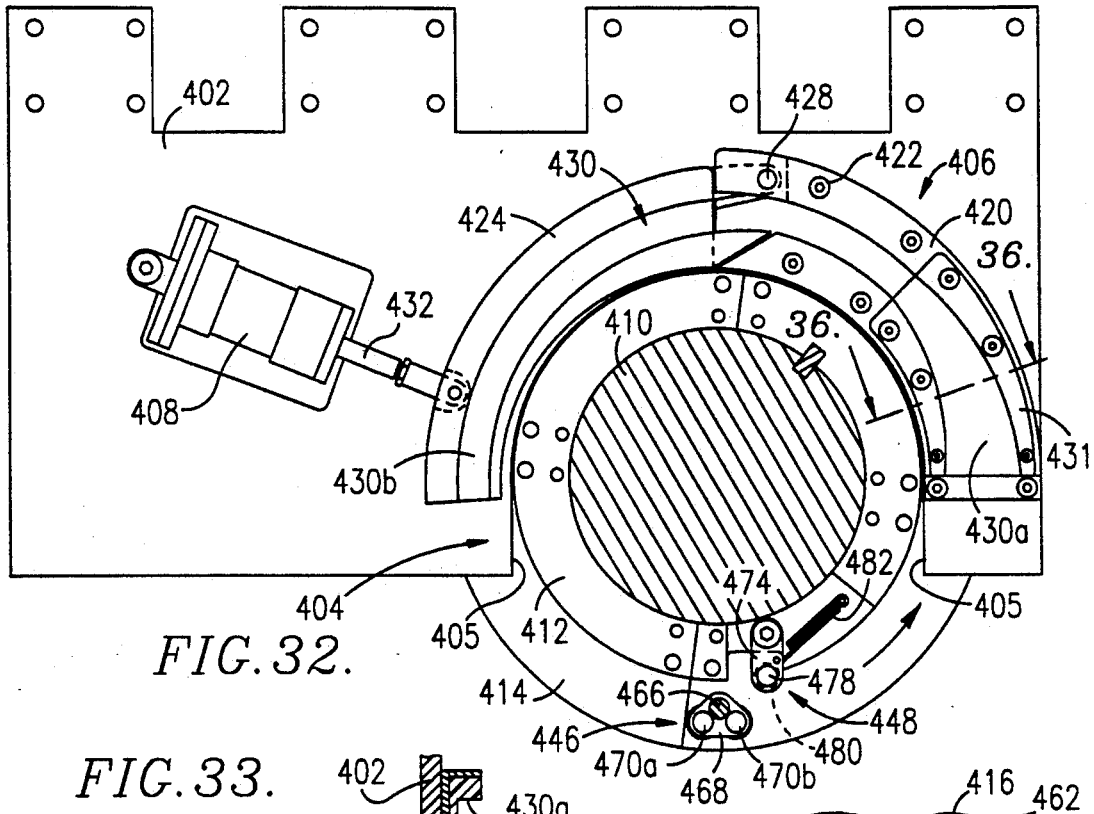
FIG. 32.
FIG. 33.
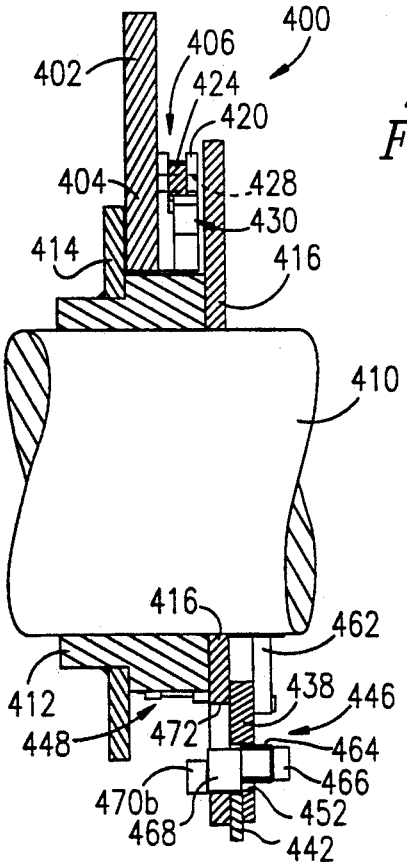
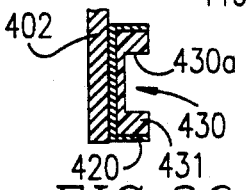
FIG. 36.
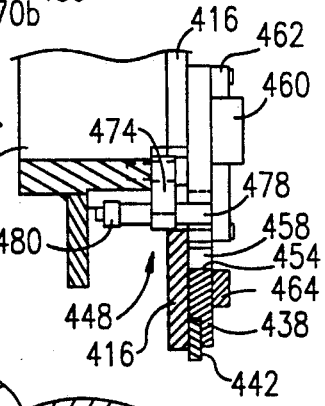
FIG. 34.
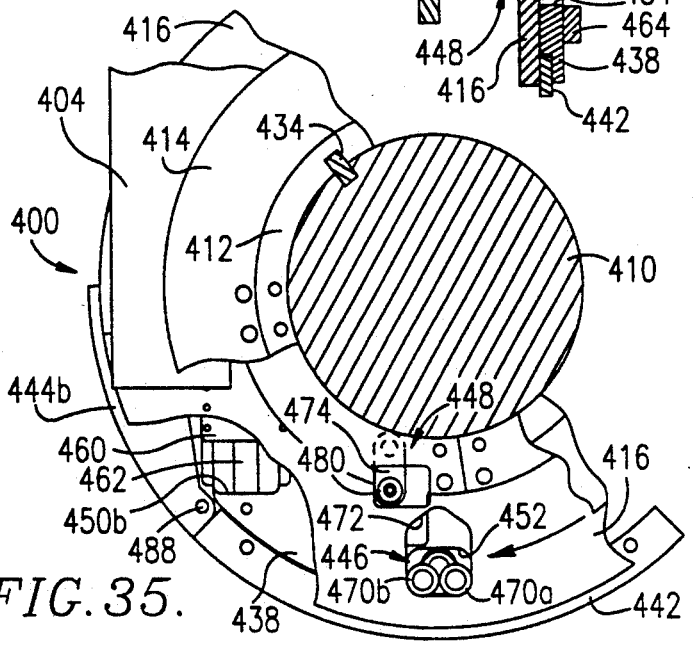
FIG. 35.

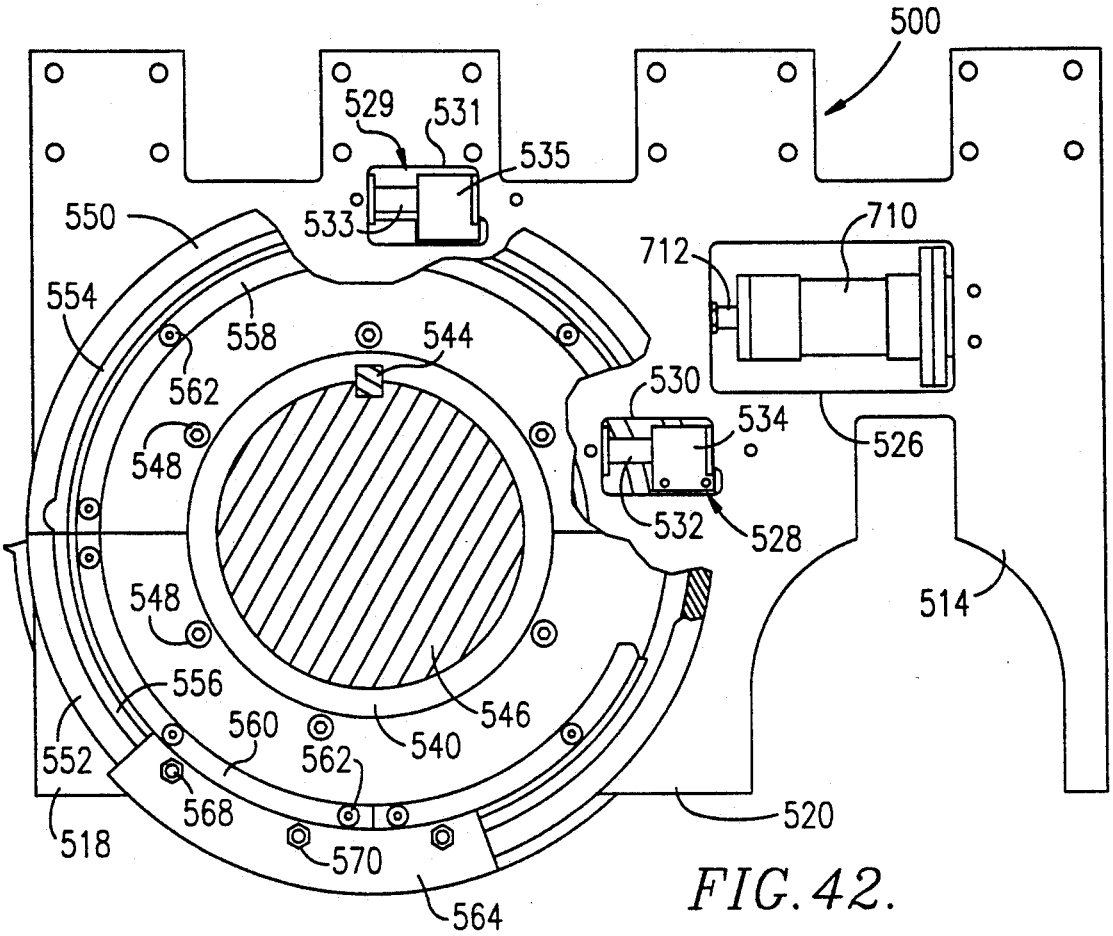
FIG. 42.
FIG. 43.
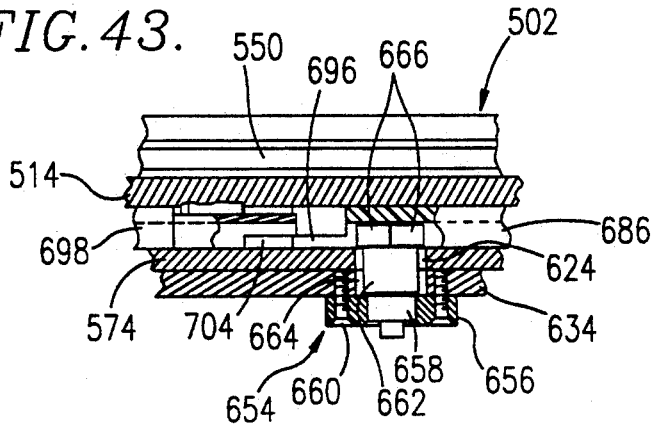

SLOTTER WHEEL MECHANISM HAVING DYNAMICALLY RETRACTABLE SLOTTER BLADES

RELATED APPLICATION

This is a continuation-in-part application of application Ser. No. 07/782,523, filed Oct. 25, 1991 now abandoned.

BACKGROUND OF THE INVENTION

1. Field of the Invention

The present invention is broadly concerned with improved slotter wheel apparatus of the type used in box making operations for the purpose of creating strategically located and sized slots in box blanks which in turn define the flap sections of an ultimate box. More particularly, it is concerned with such slotter wheel apparatus having dynamically retractable slotter blades permitting use of a given slotter wheel in the production of a wide variety of box blank sizes; in particular, the apparatus hereof permits retraction of slotter blades during rotation of the slotter wheel so that blanks of virtually any practical length can be formed on standard sized slotting machines. In addition, sectionalized, pivotally interconnected slotter blade constructions are described which in the cutting positions thereof extend through an arc greater than 180°, while nevertheless being fully retractable into a collapsed, folded-together orientation.

2. Description of the Prior Art

Conventional box making operations involve initially die cutting a box blank typically formed of corrugated board, followed by subjecting the blank to creasing and slotting steps in order to define the sides and end flaps of the blank. Generally speaking, the creasing and slotting operations are performed using adjacent, serially aligned creasing and slotting wheels respectively mounted upon powered shafts. As the blank is fed through the creasing/slotting device, the rotating creasing and slotting wheels act on the blank to create a series of spaced slot pairs of desired length separated by continuous creases. In this manner, the side panels of the final box are formed, along with the end closure flaps thereof. In order to efficiently produce blanks of varying dimensions, the slotting and creasing wheels may be shifted laterally along the lengths of their supporting shafts; moreover, cutting blades of varying lengths may be bolted to the slotting wheels at any one of a number of positions thereon, so that the size and location of the flap-defining slots may be altered.

While creasing/slotting devices of the type described are well known, they suffer from a serious drawback in that there are definite limitations as to the size of blanks which they may accommodate and process. That is, the maximum blank length which may be handled using a conventional slotter wheel is determined by the effective diameter of the wheel and knife blade. If it is desired to produce a larger blank, the only recourse is to employ a larger, more expensive slotting device. As will be appreciated, this problem stems from the fact that the slotter blade carried by conventional slotter wheel is fixed during rotation thereof and accordingly creates a corresponding slot during every wheel revolution.

U.S. Pat. No. 4,805,502 describes a slotter wheel device wherein the wheel-supporting shaft is equipped with an eccentric permitting selective movement of the supported slotting blades to a non-cutting position.

However, the apparatus described in the '502 patent is incapable of moving a slotting blade between an extended slotting position and a retracted, blank-clearing position during rotation of the slotting wheel. In short, it is necessary to stop the operation of the wheel, manipulate the eccentric to alter the blade position, and then resume operations. Accordingly, the device described in this patent cannot accommodate oversized blanks and suffers from the same deficiencies as conventional slotters.

SUMMARY OF THE INVENTION

The present invention overcomes the problems outlined above, and provides a greatly improved slotter apparatus for box making operations which, by virtue of a unique, dynamic blade-shifting mechanism, allows the operator to "skip" cutting during one or more successive slotter wheel revolutions. In this fashion, blanks of virtually any required size may be readily accommodated without the need for employing ever larger diameter slotter wheels.

Broadly speaking, the slotter wheel apparatus of the invention includes a rotatable body, generally an annular wheel construction, presenting a peripheral margin. One or more arcuate slotter blades also form a part of the invention, with each presenting an outermost cutting edge. Finally, means is provided for operably coupling the blade(s) with the rotatable body and including structure for shifting of the blade during rotation of the body between an extended slotting position and a retracted blank-clearing position. In the slotting position, the blade cutting edge is positioned outboard of the peripheral margin of the rotatable body, whereas in the retracted position, this cutting edge is preferably inboard of the peripheral margin, but in any case will pass a blank without slotting thereof.

In one embodiment of the invention, the blade-shifting structure includes means for selectively moving the blade between the respective positions thereof. In this fashion, a given blade may be extended to perform a desired cutting operation, then retracted for one or more revolutions of the supporting wheel, and finally extended again to create the opposed blank slot. Thus, the slotter device may accommodate and form a blank of virtually any applicable size. Such selective blade shifting is advantageously accomplished by providing a stationary plate adjacent the rotatable blade-supporting wheel, with a pair of proximal, arcuate cam slots being formed in the plate. A cam follower is operatively secured to the blade (i.e., the follower is coupled to a shiftable blade holder supporting the blade on the wheel), with the follower being alternately receivable within the cam slots. The innermost cam slot corresponds to the retracted position of the blade, whereas the outer cam slot corresponds to the slotting position of the blade. In order to selectively direct the cam follower to one or the other of the cam slots, a pivotal cam switch is provided. This switch is likewise slotted to accommodate the follower, and may be selectively pivoted so as to direct the follower to either the inner or outer cam slots during wheel rotation.

In another embodiment of the invention, the blade-shifting structure is designed for placing the blade in the extending slotting position thereof during alternating revolutions of the slotter wheel. To this end, the blade is moved through the medium of a rotatable spider secured to the wheel and presenting a plurality (i.e., four) of circumferentially spaced arms. A stationary plate adjacent the wheel is equipped with outwardly extending screws oriented for engaging the spider arms during rotation so as to alternately move the blade between the retracted and extended positions thereof.

The present invention also comprehends use of a sectionalized cutting blade which in the cutting position extends through an arc greater than 180°. Nevertheless, by virtue of the toggle-type folding mechanism of the blade, it may be fully retracted on a selective basis. Thus, use of such a long blade assures even greater operational flexibility for the slotter wheel mechanism of the invention.

BRIEF DESCRIPTION OF THE DRAWINGS

FIG. 32 is an elevational view of the apparatus of FIG. 28 shown with the blade assembly and pull wheel removed for clarity of illustration;

FIG. 33 is a sectional view taken along line 33—13 of FIG. 30;

FIG. 34 is a sectional view taken along line 34—34 of FIG. 30;

FIG. 35 is a rear elevational view of the apparatus of FIG. 28 with portions broken away for clarity of illustration;

FIG. 36 is a partial sectional view taken along line 36—36 of FIG. 32;

FIG. 42 is a fragmentary view in vertical section illustrating the side of the apparatus remote from that depicted in FIG. 37; and FIG. 43 is a fragmentary sectional view illustrating the tongue and groove interfit between the fixed and movable cam track sections of the apparatus of FIG. 37.

DETAILED DESCRIPTION OF THE PREFERRED EMBODIMENTS

Embodiment of FIGS. 1-7

Figure 1:
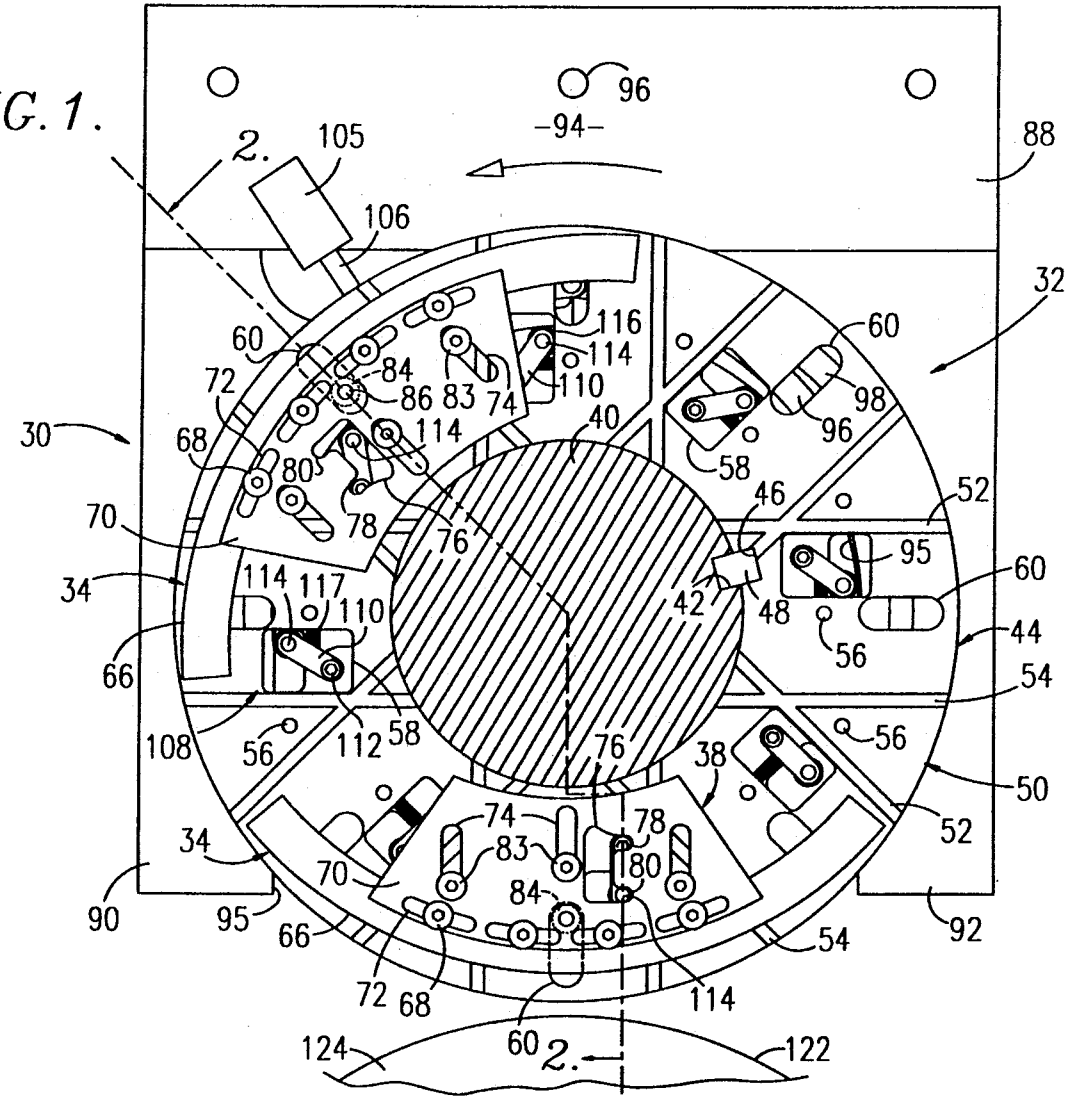
FIG. 1 is a side elevational view of slotter wheel apparatus in accordance with the invention.

Turning now to the drawings, and particularly FIGS. 1-5, a slotter wheel apparatus 30 is depicted. The apparatus 30 broadly includes a rotatable wheel assembly 32, at least one slotter blade 34, and means broadly referred to by the numeral 38 for operably coupling blade with wheel assembly 32, such means 38 including structure for shifting of the blade 34 during rotation of wheel assembly 32 between extended and retracted positions.

Figure 2:
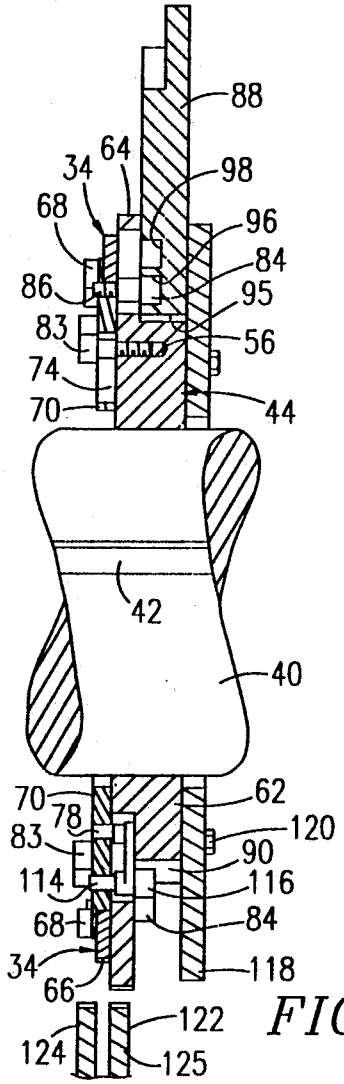
FIG. 2 is a sectional view taken along line 2—2 of FIG. 1.
Figure 4:
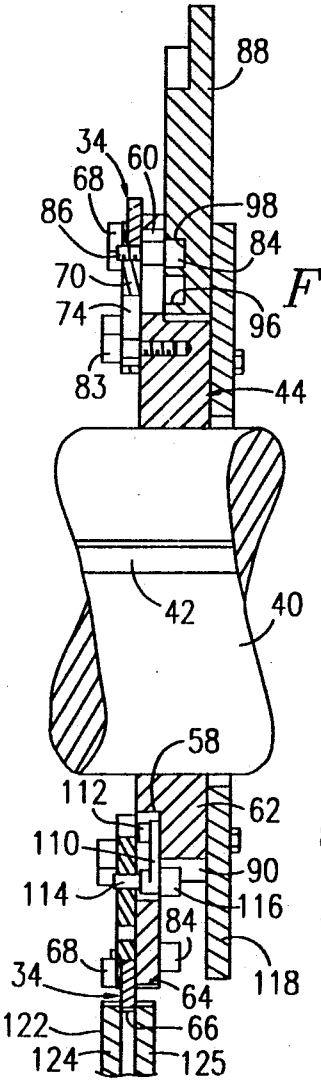
FIG. 4 is a sectional view taken along line 4—4 of FIG. 3.
Figure 5:
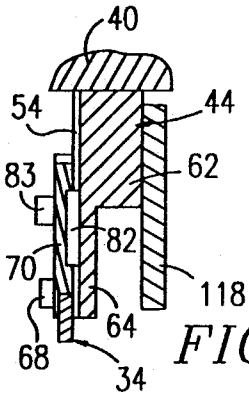
FIG. 5 is a sectional view taken along line 5—5 of FIG. 3.

In more detail, the wheel apparatus 32 includes an elongated, transversely extending, metallic rotatable shaft 40 having a keyway 42 extending along the length thereof. An annular metallic wheel 44, having a keyway 46 therein, is secured to shaft 40 for rotation therewith by means of key 48. The outer face of wheel 44 is configured to present a total of eight blade-mounting keyway sets 50 therein, with the respective sets being circumferentially spaced as illustrated. Each set 50 includes a pair of separate keyway grooves 52, 54, with the latter being crossed as illustrated to generally form an "X" pattern. The wheel 44 is also provided with a total of sixteen threaded apertures 56 therethrough with the apertures being equally spaced about the wheel as depicted. In addition, the wheel has a total of eight rectangular openings 58 each being adjacent a corresponding keyway set 50; and eight slots 60 each positioned centrally between a pair of keyway sets 50. As best seen in FIGS. 2 and 4, the wheel 44 includes an innermost body portion 62 of substantial thickness, together with a radially outwardly extending peripheral portion 64 of lesser thickness.

Slotter blade 34 is in the form of an arcuate metallic body presenting an outermost blank cutting edge 66. The blade 34 also has a total of four threaded openings therein, each receiving a corresponding shoulder screw 68 for purposes to be described.

Coupling means 36 and structure 38 includes, for each blade 34, a somewhat sector-shaped blade holder 70. The latter has a total of four circumferentially spaced blade mounting slots 72 adjacent the outer periphery thereof, together with three guide slots 74 and an irregular opening 76 having spaced lobe regions 78, 80. As will be readily appreciated from a study of FIGS. 1-5, a blade 34 is secured to the outer margin of a corresponding blade holder 70 by means of the shoulder screws 68 passing through the slots 72 and being threaded into the underlying blade.

The underside of each blade holder is provided with a pair of keys 82 (see FIG. 5) which fit into the corresponding keyway grooves 52 and 54 of an adjacent pair of keyway sets 50, in order to guide the blade holder during radial reciprocation thereof. In addition, shoulder bolts 83 pass through each of the slots 74 and are received within underlying threaded apertures 56 provided in wheel 44. In this fashion, the blade holder 70, and thus attached blade 34, move in unison in an essentially radial manner during operation of apparatus 30.

The underside of blade holder 70 is equipped with an inwardly extending cam follower 84 which passes through the corresponding slot 60 as illustrated. As best seen in FIG. 4, the follower 84 is affixed to blade holder 70 by means of threaded screw section 86.

Figure 3:
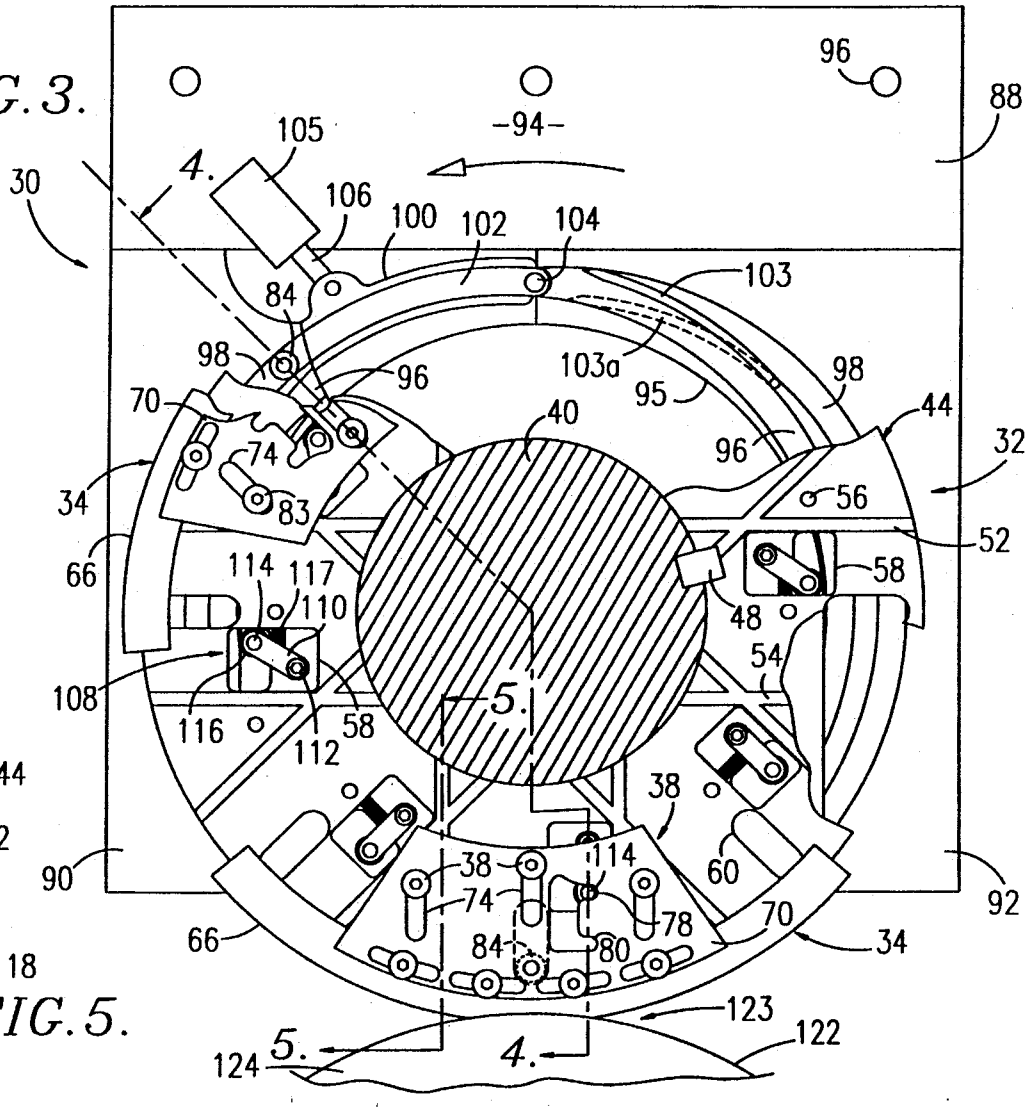
FIG. 3 is a view similar to that of FIG. 1 but having parts broken away and illustrating the shiftable blades in their outboard slotting positions.

A stationary yoke plate 88 is positioned adjacent wheel 44 and has a pair of spaced apart, depending leg sections 90, 92 together with an uppermost bight section 94 joining the leg sections. The above-described sections of plate 88 thus present an innermost continuous cam surface 95. Bight section 94 is in turn provided with mounting apertures 96 permitting mounting of the yoke plate on a shiftable carriage (not shown). As best seen in FIGS. 2 and 4, the yoke plate 88 is positioned behind peripheral portion 64 of the wheel 44, and is provided with a pair of inner and outer, adjacent cam tracks 96, 98 in each of the leg sections 90, 92. Referring specifically to FIG. 3, it will be observed that the cam tracks 6, 98 in bight section 94 merge and form a single track portion 99 adjacent the upper central region of yoke 88. At such upper central region, the yoke plate is equipped with a shiftable cam switch 100 in the form of an elongated, arcuate body presenting a single cam track 102 in the outer face thereof. The switch 100 is pivotally secured to the yoke plate 88 by means of pin 104, and can be selectively moved to merge and communicate with the spaced cam tracks 96, 98 on leg portion 90 of yoke 88. Thus, it will be seen that the track 102 of switch 100 effectively defines a continuation of single track portion 99 which can alternately communicate the latter with either of the spaced cam tracks 96, 98 in leg portion 90. Movement of cam switch 100 is effected by means of solenoid 105 having plunger 106 coupled to switch 100 as illustrated.

The overall coupling means 38 further includes locking assemblies 108 for holding the blades 34 at either the inner, retracted position thereof or the corresponding extended, blank-slotting position. Each of the assemblies 108 includes an elongated pivot arm 110 situated generally within a corresponding rectangular opening 58. Each arm 110 is secured to wheel 44 by means of endmost pivot pin 112 (see FIG. 4), whereas the exposed arm end includes a forwardly extending locking pin 114 and an oppositely extending cam follower 116. Each locking pin 114 extends into the opening 76 of the adjacent blade holder 70, and is sized to alternately fit within the lobe regions 78, 80 thereof. Finally, a compression spring 117 engages each arm 110 between the ends thereof, serving to urge the locking pin 114 into the respective lobe regions 78, 80.

In order to stabilize the overall apparatus 30, an annular backing plate 118 is positioned adjacent the rearward face of wheel 44 and is secured thereto by means of screws 120. As shown in FIG. 2, the plate 118 rotates with wheel 44, and engages the rear face of stationary yoke plate 88.

FIG. 1 depicts apparatus 30 with the respective slotting blades 34 thereof in their retracted, non-cutting positions. In such orientation, the cam followers 84 associated with each blade holder 70 are positioned within the inner cam tracks 96 during rotation of wheel 44; moreover, the cam switch 100 is positioned to communicate the merged cam track section 99 with the cam track 96 of yoke leg 90. The followers 84 also move guide 103 to the position shown in phantom in FIG. 3, so that there is a smooth transition within section 99 to switch 100. Thus, during rotation of wheel 44 (effected by powered rotation of shaft 40), the respective cutting blades 44 will remain retracted. Further, as the wheel 44 rotates the cam followers 116 engage the cam surface 95, thereby locking the blade holders in position during such contact. When the cam followers 116 break contact with the surface 95, the springs 117 act upon the corresponding pivot arms 110, thereby urging the associated locking pin 114 into the lobe regions 80 of the irregular openings 76.

When it is necessary to extend the cutting blades 34 to the FIG. 3 position thereof, it is only necessary to actuate solenoid 105 in order to pivot cam switch 100 to the position shown in FIG. 3, i.e., until the track 102 communicates cam track section 99 with outboard cam track 98 of leg 90. Thereupon, as wheel 44 rotates the cam followers 84 of the individual blade holders 70 will pass from the inboard cam track 96 of yoke leg 92 to the merged track section 99, through the track 102 of switch 100, and finally to the outboard cam track 98 of leg 90. During this transition the corresponding blade holders will be cammed outwardly, such being accommodated by the slots 60 and 74. As the wheel 44 continues to rotate with the followers 84 proceeding through the outboard track 98, the cam followers 116 engaging yoke surface 95 will maintain the position of the blades. When contact between the followers 116 and surface 95 is broken, the springs 117 will again act, and in this instance urge the locking pins 114 into the upper lobe regions 78, thereby locking the blades 34 in place during slotting operations.

It will thus be appreciated that apparatus 30 may be operated to initially extend one or more of the cutting blades 34 for blank slotting purposes, whereupon these blades may be individually retracted for one or more revolutions of wheel 44, until such time as it is necessary to again extend the blades for additional slotting of a blank. Such operations are carried out during continued rotation of the wheel 44, without the need for stopping the wheel or in any way interfering with otherwise normal blank slotting.

As those skilled in the art will appreciate, use of the wheel apparatus 30 is conventionally carried out in conjunction with a lowermost anvil wheel 122 to present a blank-receiving nip region 123 between these wheels. The wheel 122 is typically of bifurcated construction, presenting a pair of spaced apart wheel plates 124, 125 which cooperatively receive edge 66 of each cutting blade 34 (see FIG. 4).

Figure 7:
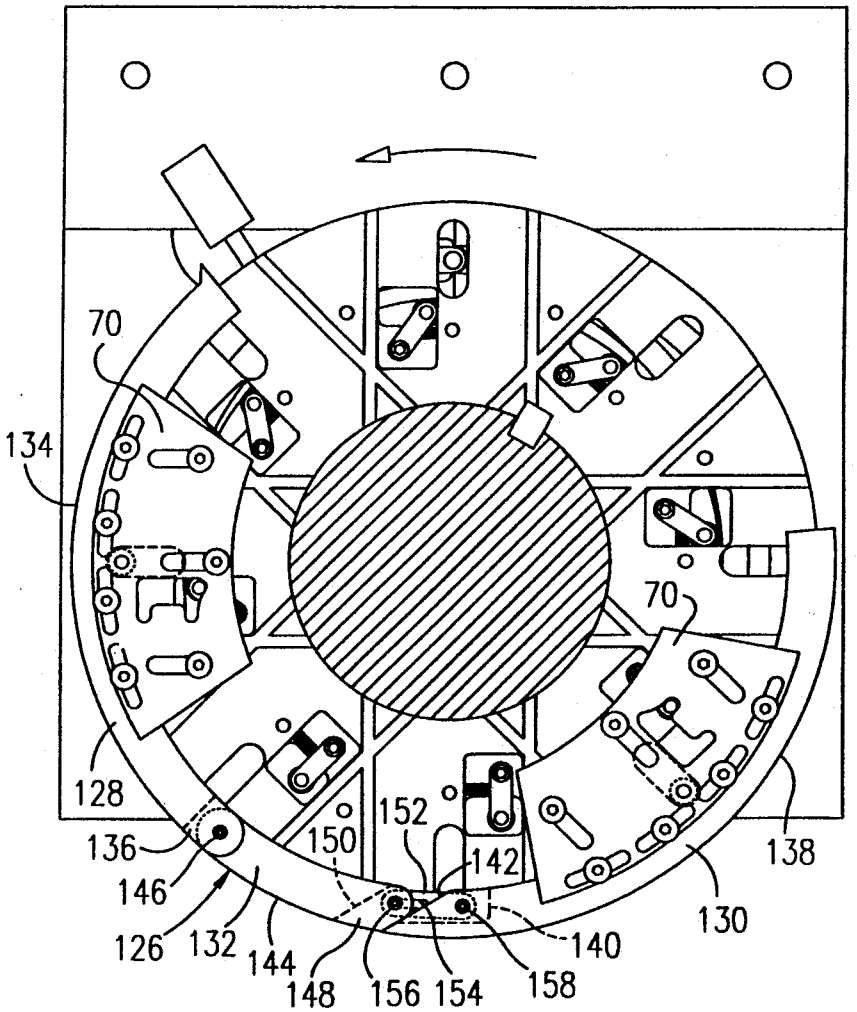
FIG. 7 is an elevational view of the type depicted in FIG. 6, but showing the sectionalized slotting blade in its outboard, slotting position.
Figure 6:
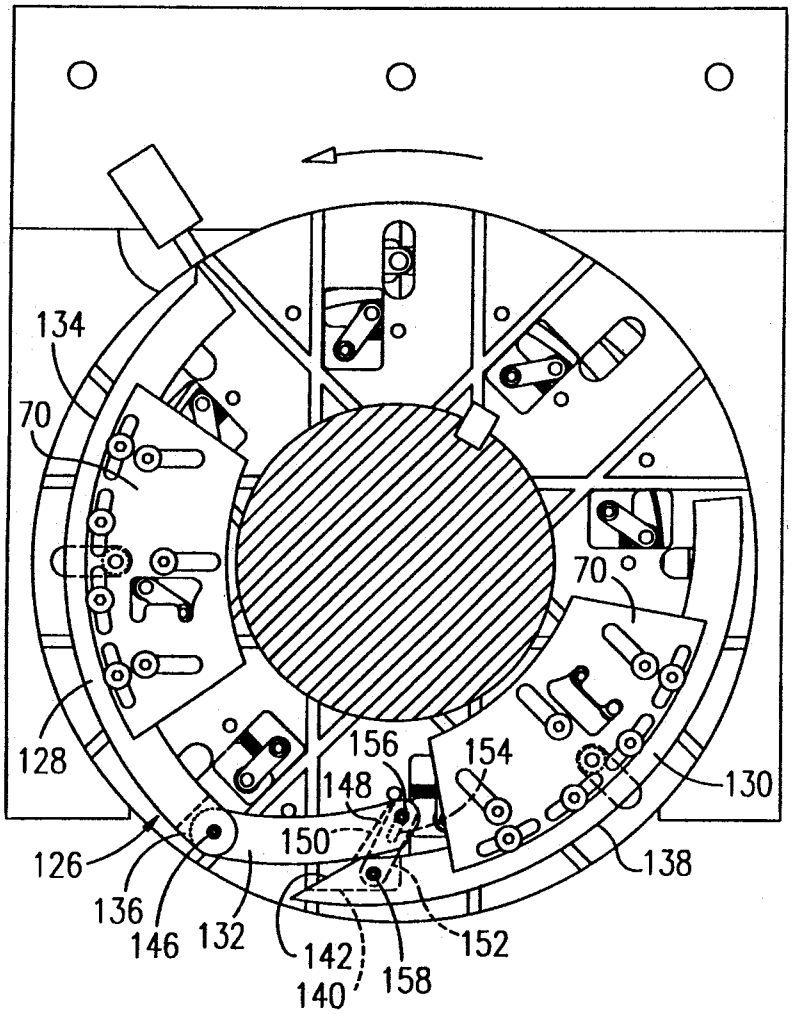
FIG. 6 is an elevational view similar to that shown in FIG. 1, but depicting the use of a sectionalized, retractable cutting blade.

Turning now to FIGS. 6–7, a second embodiment of the invention is shown which is identical in all respect to that described with reference to FIGS. 1–5, save for the use of a multiple section, segmented cutting blade assembly 126. As shown, the assembly 126 is supported on a pair of adjacent blade holders 70. Inasmuch as the FIGS. 6–7 apparatus is identical except for the blade assembly 126, only the latter will be described in detail.

In particular, the assembly 126 includes a pair of elongated, arcuate sections 128, 130 interconnected by an intermediate blade section 132. Blade section 128 includes an outermost cutting edge 134 and a bifurcated end 136. The section 130 likewise has an outboard cutting edge 138, as well as a bifurcated end 140. The latter terminated in an oblique terminus 142 as shown.

Intermediate section 132 has outboard cutting edge 144 with the left hand end of the intermediate section 132 as viewed in FIGS. 6–7 fitted within bifurcated end 136 and pivoted thereto by means of pin 146. The opposed end of section 132 is likewise bifurcated as at 148, and has an oblique inner wall 150. A short link 152 serves to interconnect the bifurcated end of 132 and that of blade section 130. The link 152 has a short slot 154 therein adjacent bifurcated end 148, with a pin 156 extending through the slot 154 to retain the link in place. The opposite end of link 152 is pivoted within bifurcated end 140 of section 130 by means of pin 158.

The extended or slotting position of blade assembly 126 is shown in FIG. 7, wherein it will be seen that the sections 128, 130 and 132 cooperatively pr®sent a continuous elongated blade which extends through an arc greater than 180°. However, such blade assembly may be fully retracted notwithstanding this arc length by virtue of the described intermediate section construction. This retracted position is shown in FIG. 6 where the intermediate section 132 is in its collapsed, folded-together condition.

Embodiment of FIGS. 8–12

Figure 11:
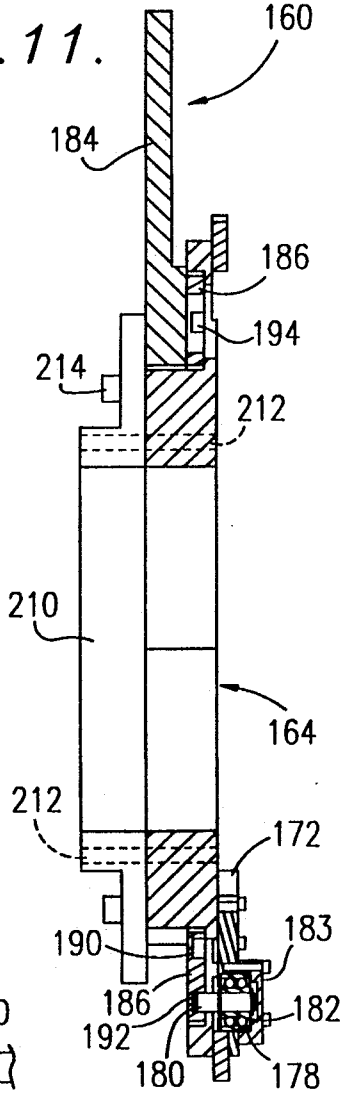
FIG. 11 is a vertical sectional view of the apparatus depicted in FIG. 8, illustrating further details of the construction.
Figure 12:
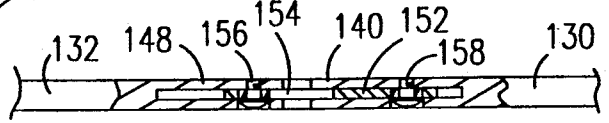
FIG. 12 is a fragmentary sectional view taken along line 12—12 of FIG. 8.
Figure 10:
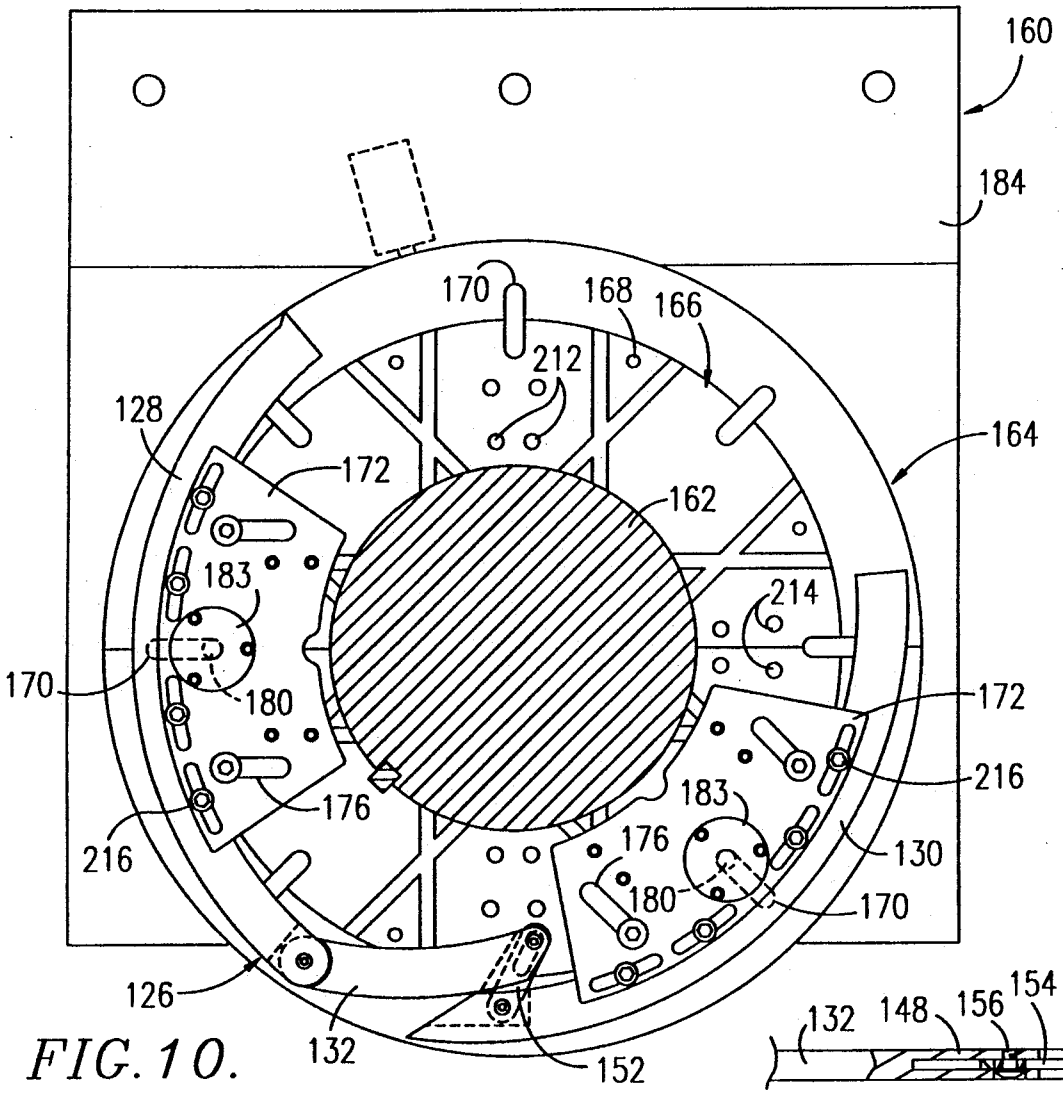
FIG. 10 is a side view similar to that shown in FIGS. 8-9, but showing the sectionalized blade in its folded-together, fully retracted position.
Figure 16:
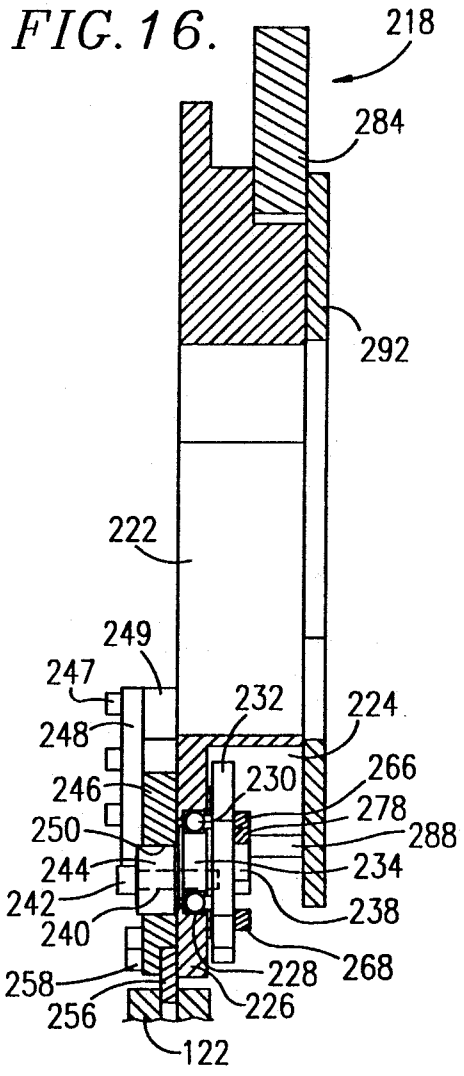
FIG. 16 is a vertical sectional view taken along line 16—16 of FIG. 13.
Figure 13:
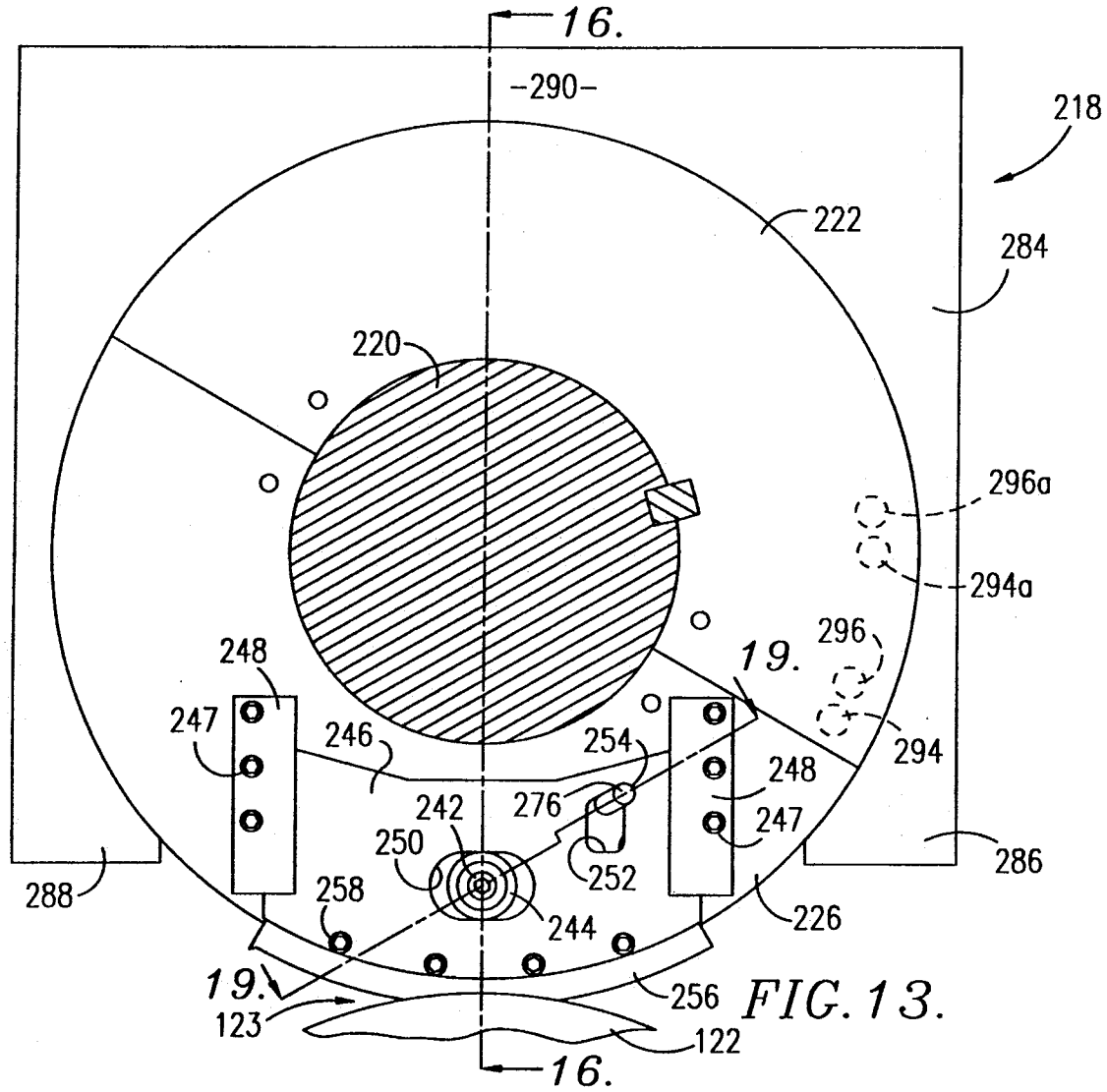
FIG. 13 is a side view of another slotter wheel apparatus in accordance with the invention, showing the supported blade in its outboard slotting position.

Another embodiment of the invention is shown in FIGS. 8–12. In this case, use is made of a continuous circular cam which eliminates the need for the locking assemblies 108 described with reference to the previous embodiments. In particular, a wheel apparatus 160 is illustrated which includes a powered, central, axially rotatable shaft 162 which supports a wheel 164. The latter includes much of the structure of wheel 44, including appropriate keyway sets 166, threaded apertures 168 and cam follower slots 170. Respective blade supports 172, each provided with a pair of keys 174 on the underside thereof, are mounted for radial movement on the wheel 164. Each blade support further includes guide slots 176, and a central opening 178. A cam follower 180 extends inwardly from the opening 178 and is supported by a conventional roller bearing assembly 182. The latter is covered by a cap 183 as best seen in FIG. 11.

The overall apparatus 160 includes a stationary yoke plate 184 similar to plate 88. In this instance, however, the plate 184 is not formed with cam grooves therein. Rather, a separate, circular, sectionalized cam plate 186 is secured to yoke plate 184 by means of screws 188. The cam plate 186 includes, throughout the majority of the circumference thereof, a pair of spaced inner and outer cam tracks 190, 192 adapted to receive cam 180 associated with each blade holder 172. At the central upper region of the cam plate 186 the cam tracks 190, 192 merge and form a single transition cam track section 194. The latter leads into a shiftable cam switch 196 having a single cam track 198 therein. The switch 196 has a rounded end 200 together with a pair of short mounting slots 202, 204. Pins 206, 208 secured to the cam plate 186 extend into the slots 202, 204, in order to permit pivoting movement of the switch 196. As will be readily apparent from a study of FIG. 8, the switch 196 can be alternately positioned to communicate with the inner and outer cam tracks 190, 192 on the left hand portion of cam plate 186.

An annular retainer plate 210 is affixed to wheel 164 by means of pins 212 and screws 214, so that the plate 210 rotates with wheel 162. At the same time, yoke 184 and cam plate 186 remain stationary and is effectively sandwiched between the retainer plate 210 and wheel 164.

The embodiment of FIGS. 8–12 depicts the use of a segmented cutting blade assembly 126 identical with that described previously. As before, the sections 128, 130 of the blade assembly are secured to the blade holders 172 by means of shoulder screws 216 extending through blade holder slots and into appropriately located openings in the blade sections.

Operation of apparatus 160 is very similar to that of the previous embodiments. During rotation of wheel 164, when the blade assembly 126 is in the retracted position (FIG. 10), the respective cam followers 180 ride within the inner cam track 190, and switch 196 is in the position opposite that shown in FIG. 8, i.e., the free end of the switch is lowered and communicates with inboard track 190. Rotation of wheel 164 may thus continue with the blade being fully retracted. When it is necessary to extend the blade, the cam switch 196 is pivoted to the FIG. 8 position, whereupon a follower 180 entering the switch track 198 will be directed to the outboard cam track 192. This in turn will cause the associated blade holder 172, and hence the attached blade section, to cam outwardly to the blank slotting orientation, with the cam follower slots 170 and blade holder slots 176 accommodating such outward movement.

Figure 9:
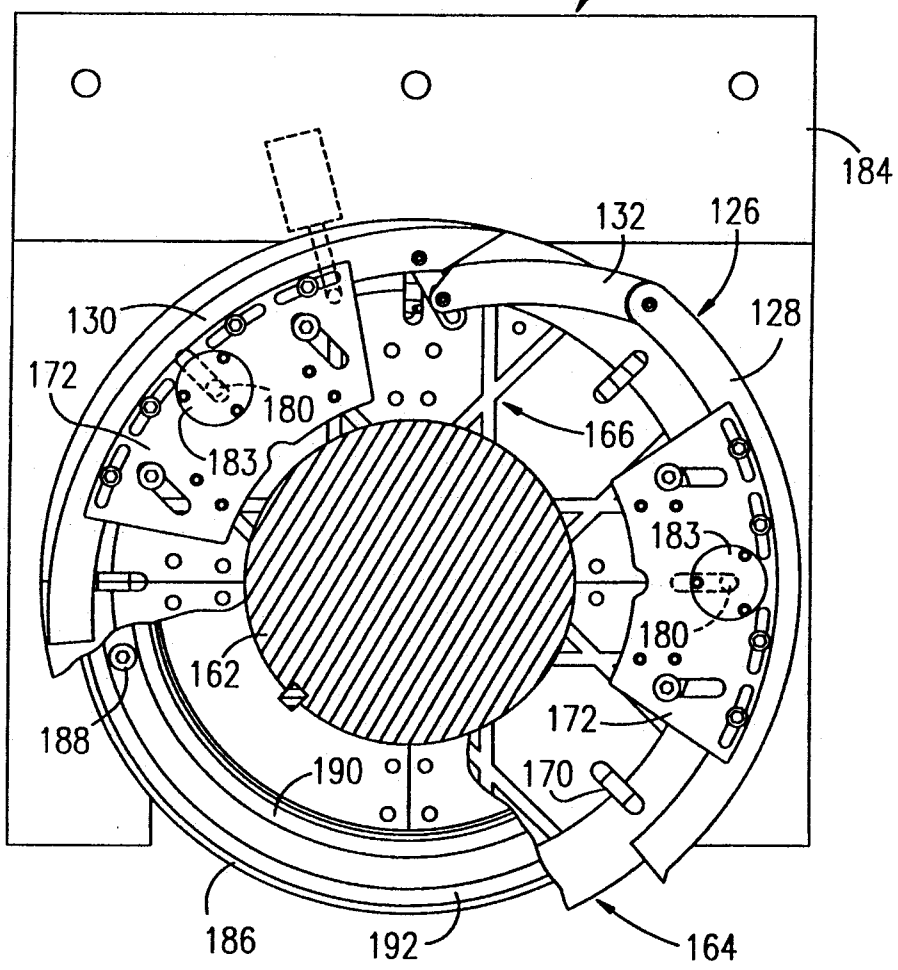
FIG. 9 is a side view similar to FIG. 8 showing other parts broken away and with the sectionalized blade moving to its fully retracted position.
Figure 8:
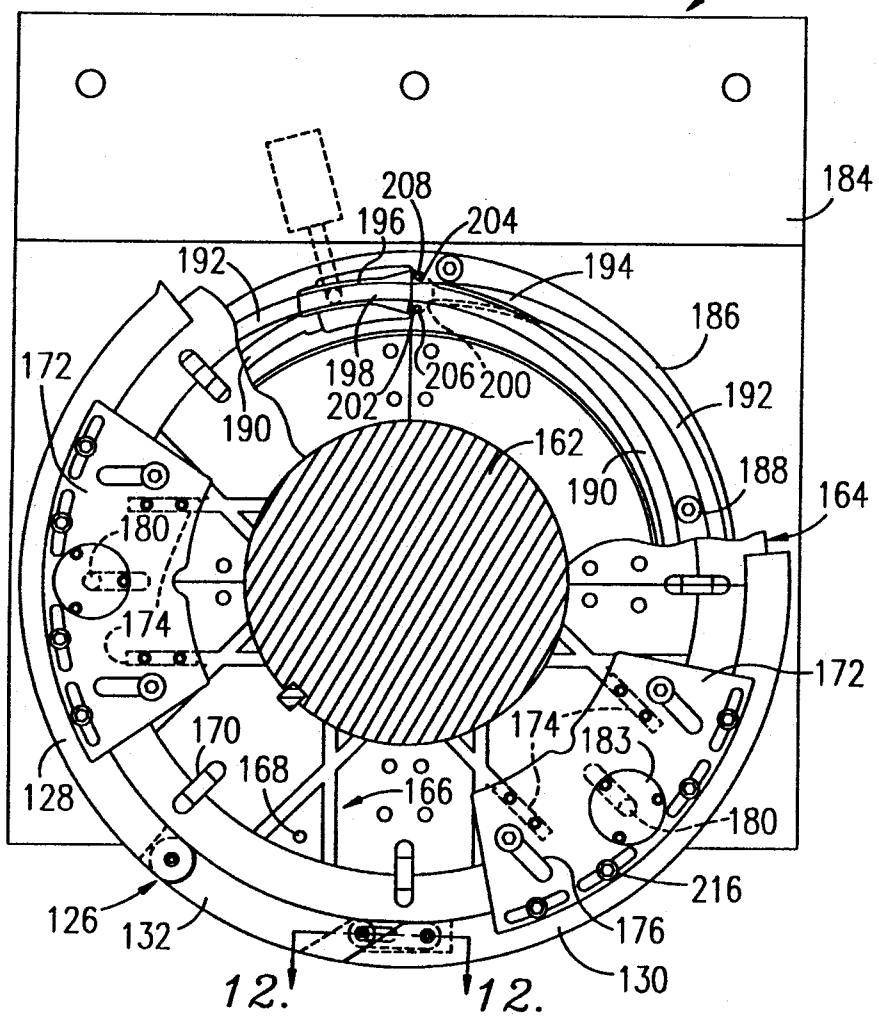
FIG. 8 is a side view with parts broken away for clarity of another embodiment wherein use is made of the sectionalized blade of the invention.

FIG. 9 illustrates the opposite sequence, when the blade is being retracted. As shown, the blade section 130 is in its blank-clearing position, whereas the trailing blade section 128 remains extended. Of course, during continued rotation of wheel 164, the section 128 will likewise be retracted until the entire assembly 126 assumes the position shown in FIG. 10.

With the FIGS. 8–12 construction, the blade holder cams 180 are continuously retained within cam tracks; as such, there is no need for the locking assemblies described previously, and the blades are continuously held in place by virtue of the cam track and follower arrangement.

Embodiment of FIGS. 13–27

Another embodiment of the invention is depicted in FIGS. 13–27. In this case, the slotting wheel apparatus 218 is designed to provide continuous extension and retraction of cutting blade(s) during each revolution. The apparatus 218 includes the normal central drive shaft 220 supporting a segmented wheel 222. The latter has a plurality of arcuate recesses 224 therein, spaced about the periphery thereof, with an outer flange section 226 extending completely about the wheel and covering the spaced recesses. The flange 226 has a circular aperture 228 centrally disposed relative to each recess, which receives a roller bearing 230 (See FIG. 18). A spider 232 having a central hub shaft 234, is situated within each recess, with the hub shaft 234 being rotatably supported by a corresponding roller bearing 230. Each spider 232 includes a total of four outwardly extending, generally arcuate operating arms 236*a*–236*d*. The face of spider opposite hub shaft 234 is provided with an oblong block 238 presenting rounded ends and flattened side surfaces. Hub shaft 234 is provided with an offset, threaded opening 240 which receives a threaded screw 242. The latter in turn supports a circular follower 244.

The wheel 222 also supports a plurality of blade holders 246, one for each spider 232. The respective blade holders 246 are mounted on the outer face of the flange 226, and are supported for radial movement by means of by a pair of guide plates 248. Each guide plate is secured by means of screws 247 and inboard spacers 249 (FIG. 18) in order to permit reciprocal movement of the blade holders. Each blade holder 246 has a central, somewhat oblong opening 250, along with an irregular aperture 252 presenting a lobe region 254. A blade 256 is affixed to the outer margin of each blade holder 246 by means of mounting screws 258.

Figure 14:
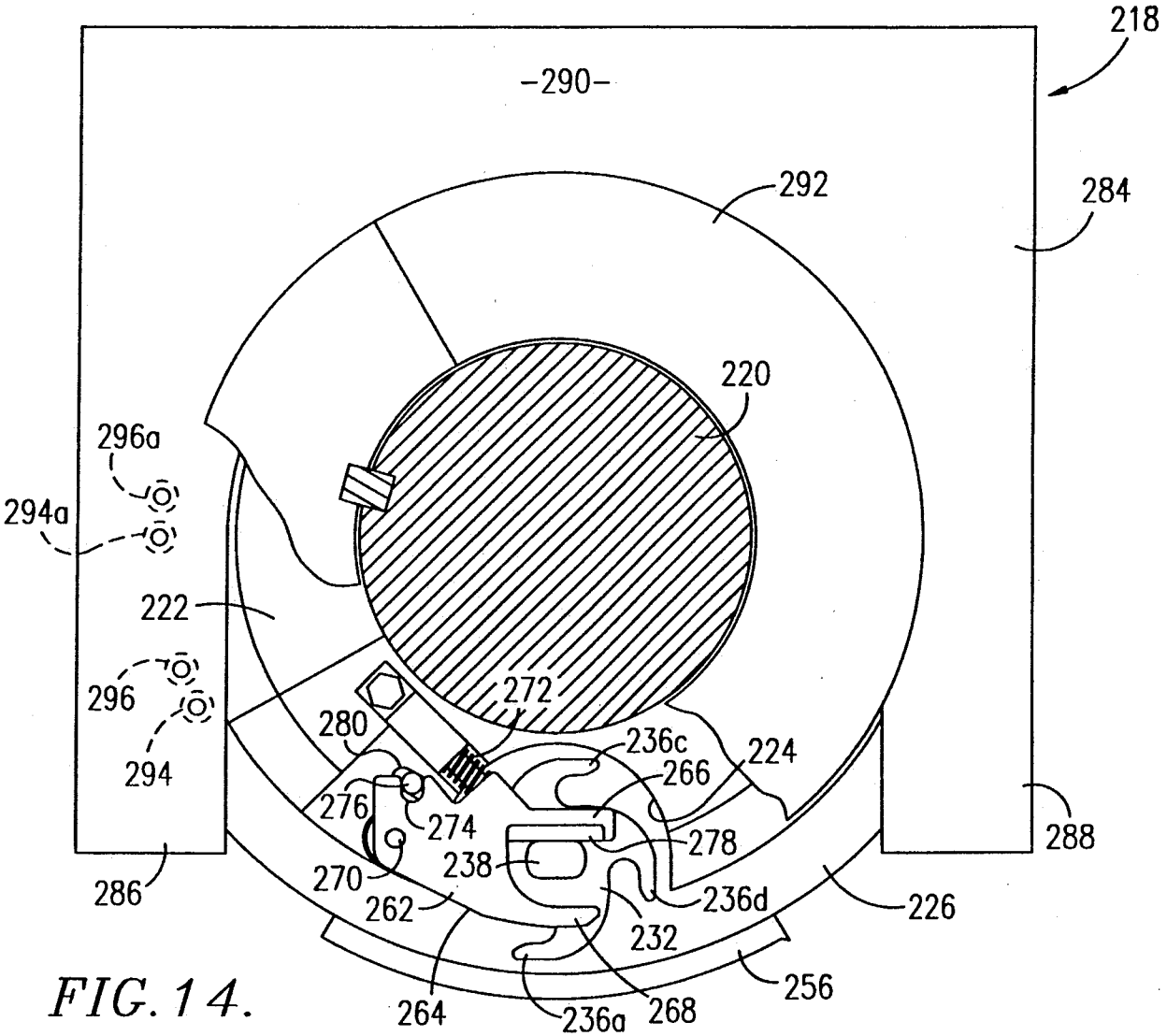
FIG. 14 is a side view of the type shown in FIG. 3, but with parts broken away to reveal the underlying spider and brake apparatus.
Figure 15:
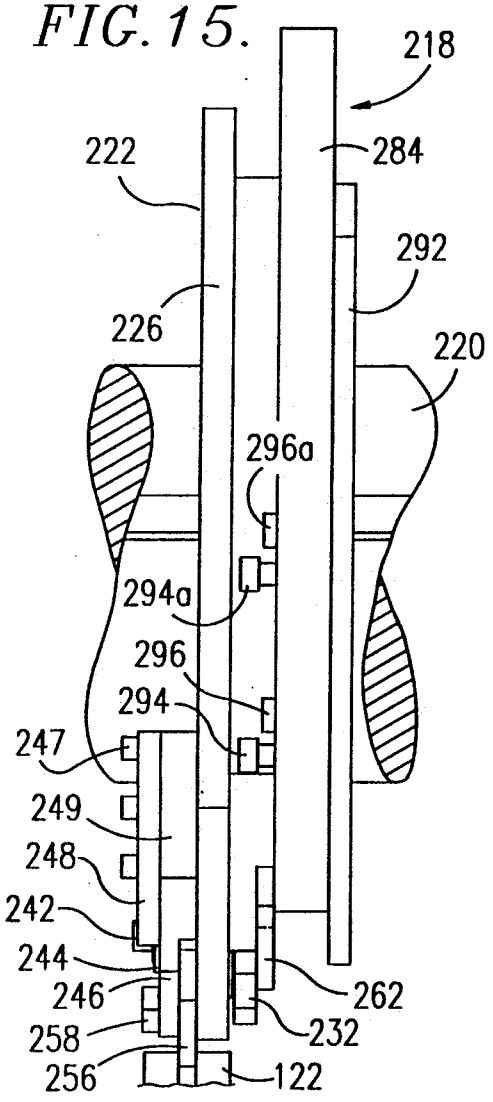
FIG. 15 is an end view of the slotter wheel shown in FIG. 14.
Figure 19:
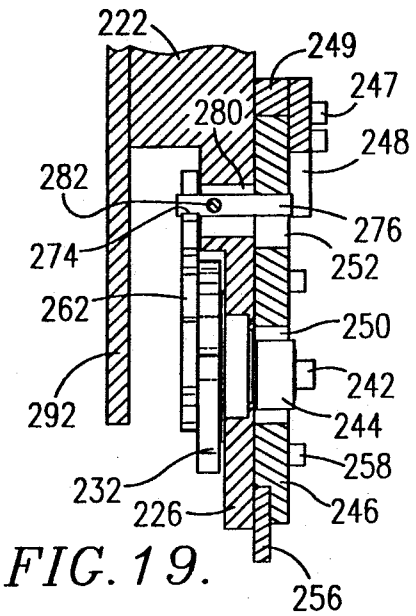
FIG. 19 is a sectional view taken along line 19—19 of FIG. 13.
Figure 18:
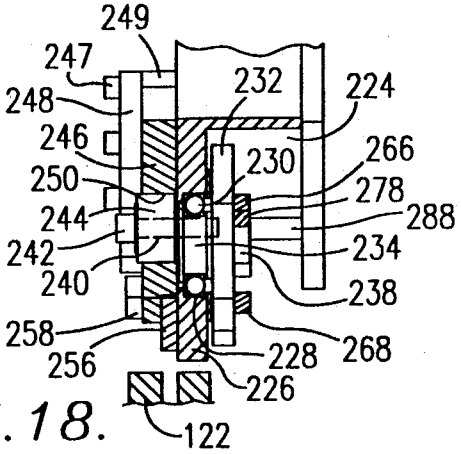
FIG. 18 is a fragmentary vertical sectional view taken along line 18-8 of FIG. 17.
Figure 17:
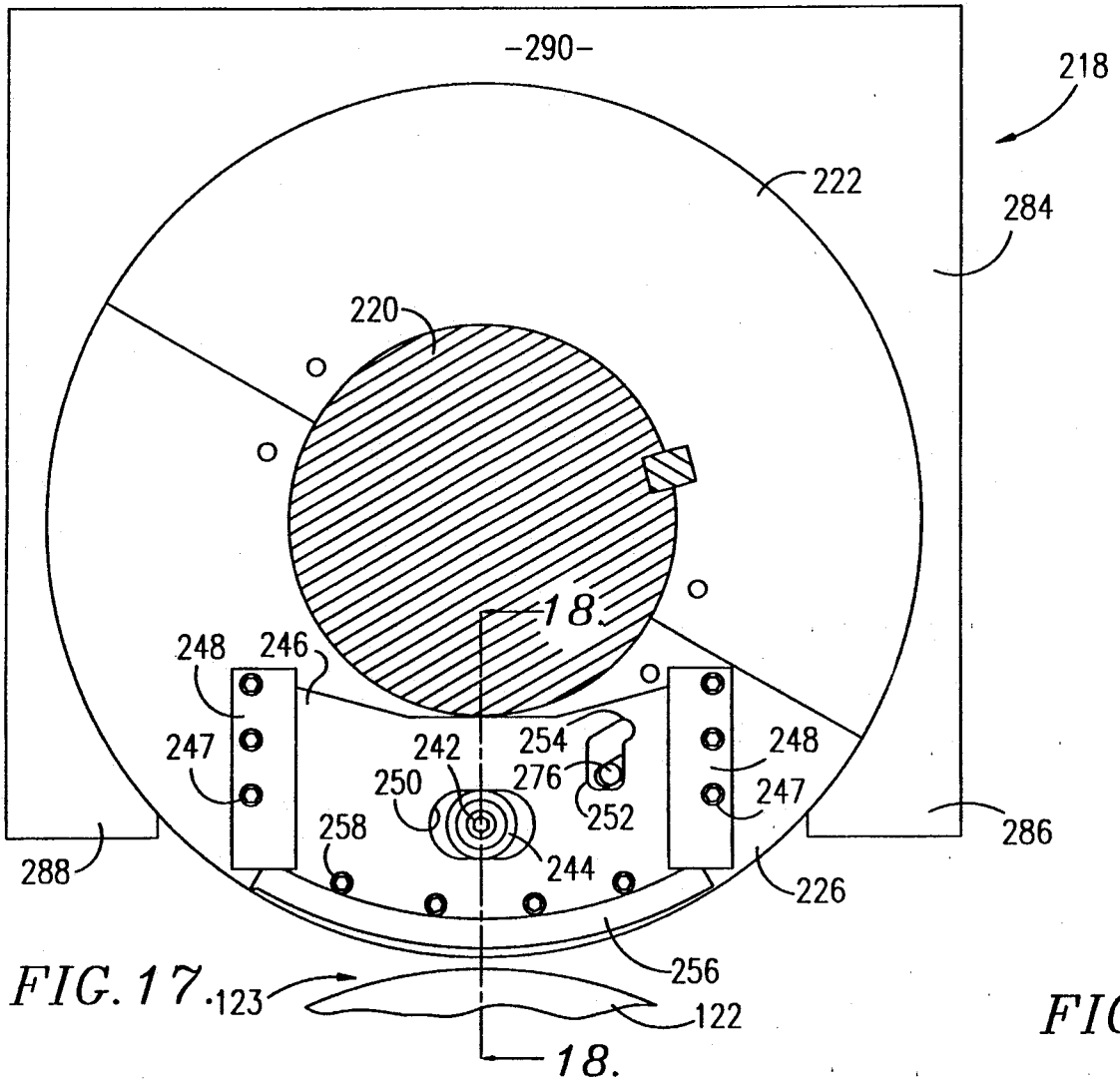
FIG. 17 is a side view of the embodiment depicted in FIGS. 13-16, but showing the blade in its retracted position.

Each spider 232 is also equipped with a spring-loaded brake assembly. Each such assembly includes a brake plate 262 presenting an outboard cam surface 264 and a pair of spaced arms 266, 268. The plate 262 is pivotally supported by pin 270, and is outwardly biased by means of compression spring 272 engaging the plate as best shown in FIG. 14. A small indentation 274 is provided in plate 262 for accommodating a locking pin 276, the purpose of which will be described. Arm 266 of the plate 262 has a synthetic resin brake pad 278 adapted to engage the flattened surfaces of block 238. Referring to FIG. 19, it will be observed that each locking pin 276 extends through an elongated bore 280 in wheel 222 and into the irregular opening 252 of the associated blade holder 246. The pin 276 is further supported for pivotal movement by means of transverse pivot shaft 282 secured within bore 280.

The overall apparatus 218 also has a stationary yoke plate 284 presenting a pair of spaced, depending arms 286, 288 and an upper, central bight section 290. The yoke plate is positioned between wheel 222 and an opposed retainer 292, the latter being affixed to wheel 222 to rotate in unison therewith. Arm 286 of yoke plate 284 has a total of four spider-engaging members secured thereto and positioned behind flange 226, specifically a pair of longer headed members 294, 294*a*, and corresponding shorter members 296, 296*a*. These members are strategically located for engaging the spider arms 236 during rotation of wheel 222, so as to effect corresponding movement of the cutting blades 256.

Figure 20:
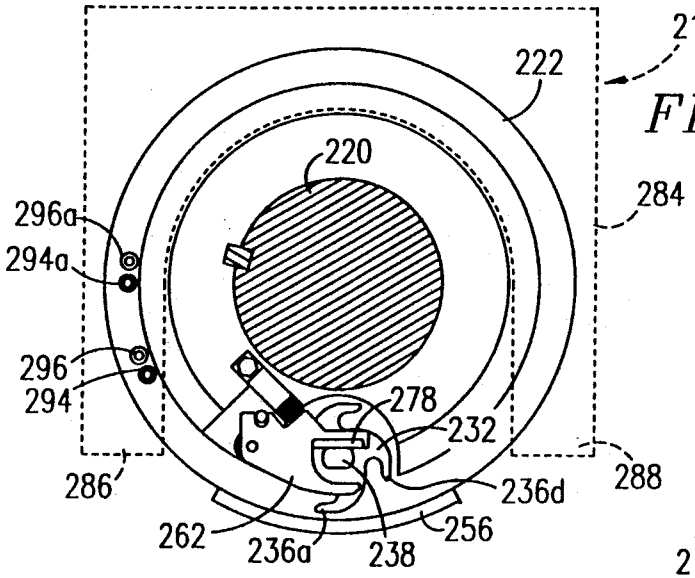
FIGS. 20-27 are respective side views of the slotter apparatus illustrated in FIGS. 13-19, showing the sequential blade-shifting operation of the spider apparatus.

The operation of apparatus 218 is best understood from a consideration of FIGS. 20–27. FIG. 20 depicts the apparatus 218 with blade 256 in its fully extended, blank-slotting position. In this orientation a flattened surface of block 238 is in engagement with brake pad 278, and locking pin 276 is pivoted into lobe region 254 of opening 252, thereby securely locking the blade in its slotting position.

Figure 21:
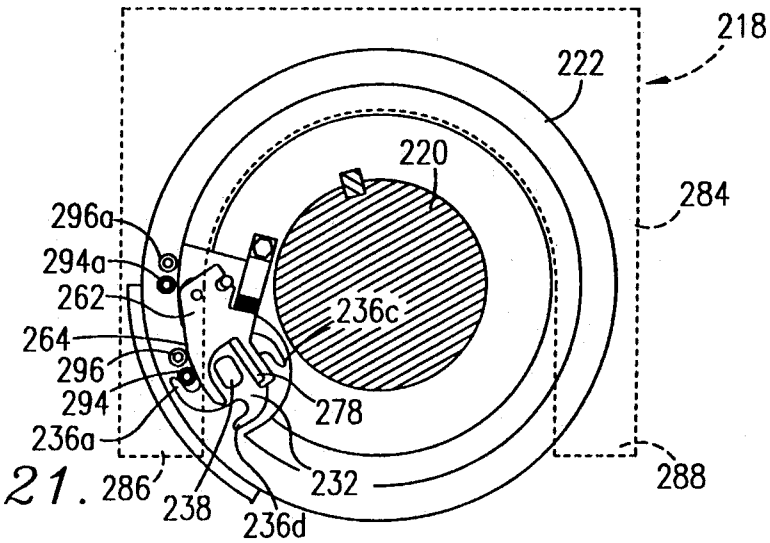
Figure 22:
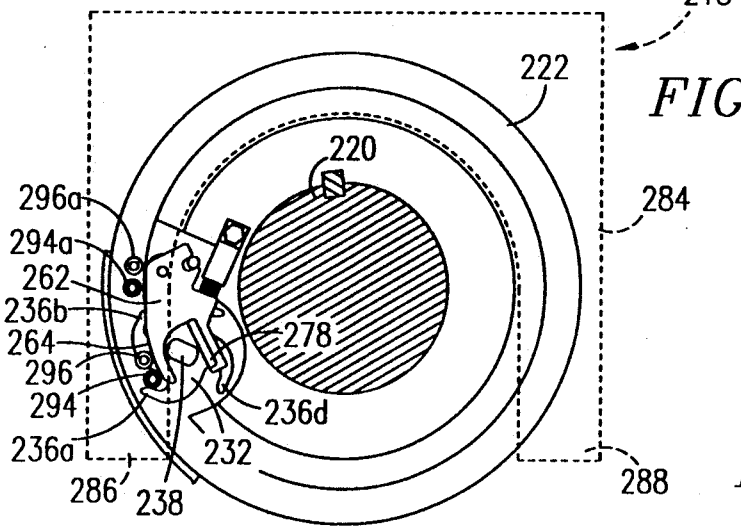

FIG. 21 depicts the wheel 222 rotated to a point where the cam surface 264 of brake plate 262 has been engaged by the lowermost yoke member 296, thereby pivoting the brake plate in a counterclockwise direction to break the contact between block 238 and brake pad 278. Pin 276 also is pivoted out of lobe region 254 to permit movement of blade holder 246. As rotation of the wheel 222 continues, the outer spider arm 236*a* comes into contact with the lower yoke member 294, which causes rotation of the spider as shown in FIG. 22. Such rotation begins the cammed retraction of blade 256 through the medium of offset follower 244 and the associated blade holder 246.

Figure 23:
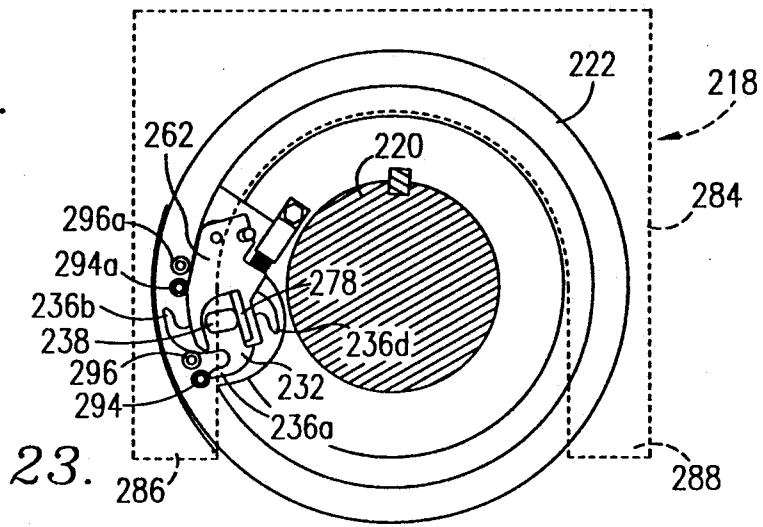
Figure 24:
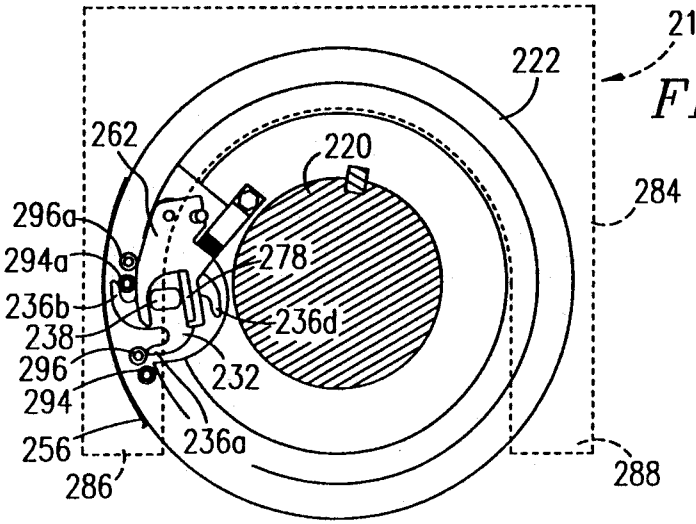
Figure 25:
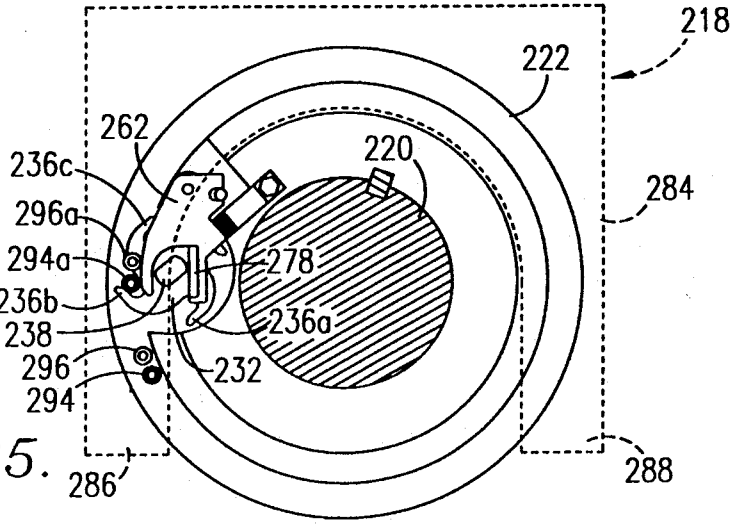
Figure 26:
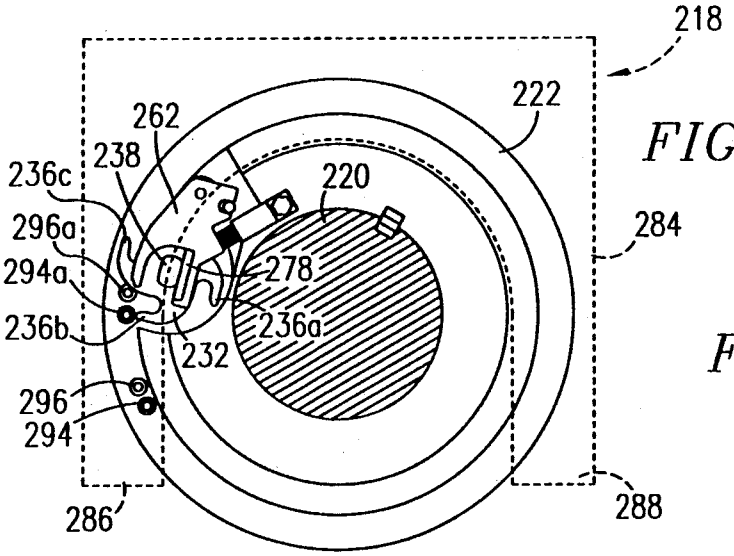
Figure 27:
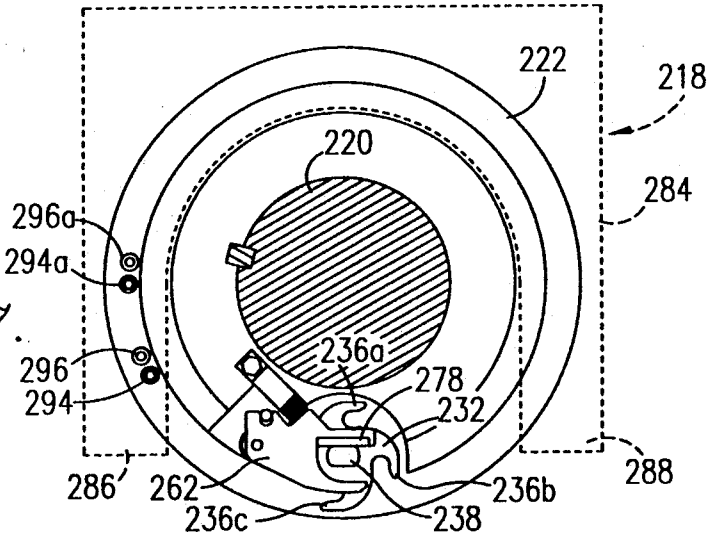

FIG. 23 shows the position of spider 232 during further rotation of wheel 222, i.e., with the rounded end of block 238 in contact with brake pad 278. This intermediate position is maintained until the wheel 222 rotates further, causing the cam surface 264 of brake plate 262 to come into contact with yoke member 296*a*. This in turn pivots the brake plate 262 and again breaks the contact between block 238 and brake pad 278 (FIG. 24). In FIG. 25, spider arm 236*b* comes into engagement with yoke member 294*a*, further rotating the spider and essentially completing the retraction of blade 256. As shown, the block 238 is again free to rotate between the brake plate arms. FIG. 26 illustrates the spider 232 again in its rest position, with brake plate 262 in full engagement with block 238, the latter occurring by virtue of the bias of spring 272. FIG. 27 depicts the wheel orientation with the blade fully retracted and passing adjacent the nip region 123 between the slotter apparatus 218 and adjacent anvil wheel 122. It will of course be appreciated that as the wheel 222 continues to rotate, the spider mechanism will again cause extension of the blade 256 as the spider 232 comes into engagement with the actuating members 294, 294*a*, 296 and 296*a*. Thus, with the apparatus 218, the blade 256 is extended for cutting operations during alternating revolutions of the wheel 222.

Figure 29:
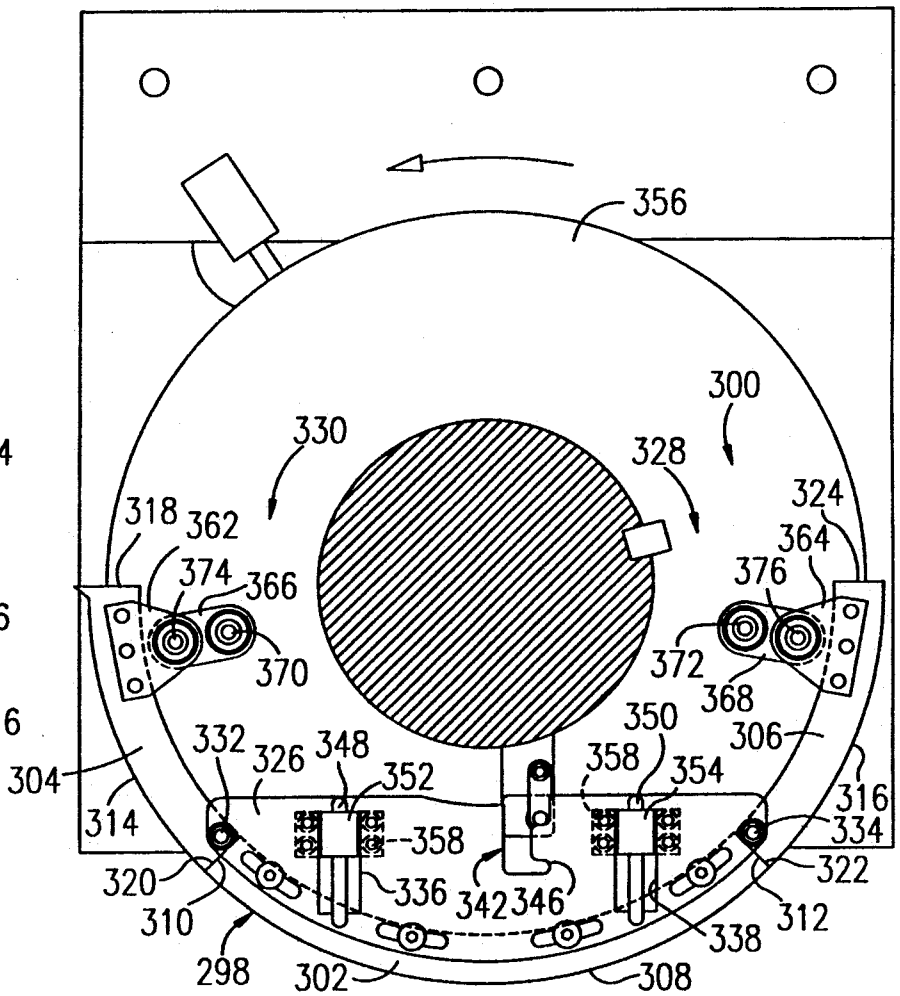
FIG. 29 is a sectional view of the slotter apparatus illustrated in FIG. 28, showing the blade in outboard slotting position.
Figure 28:
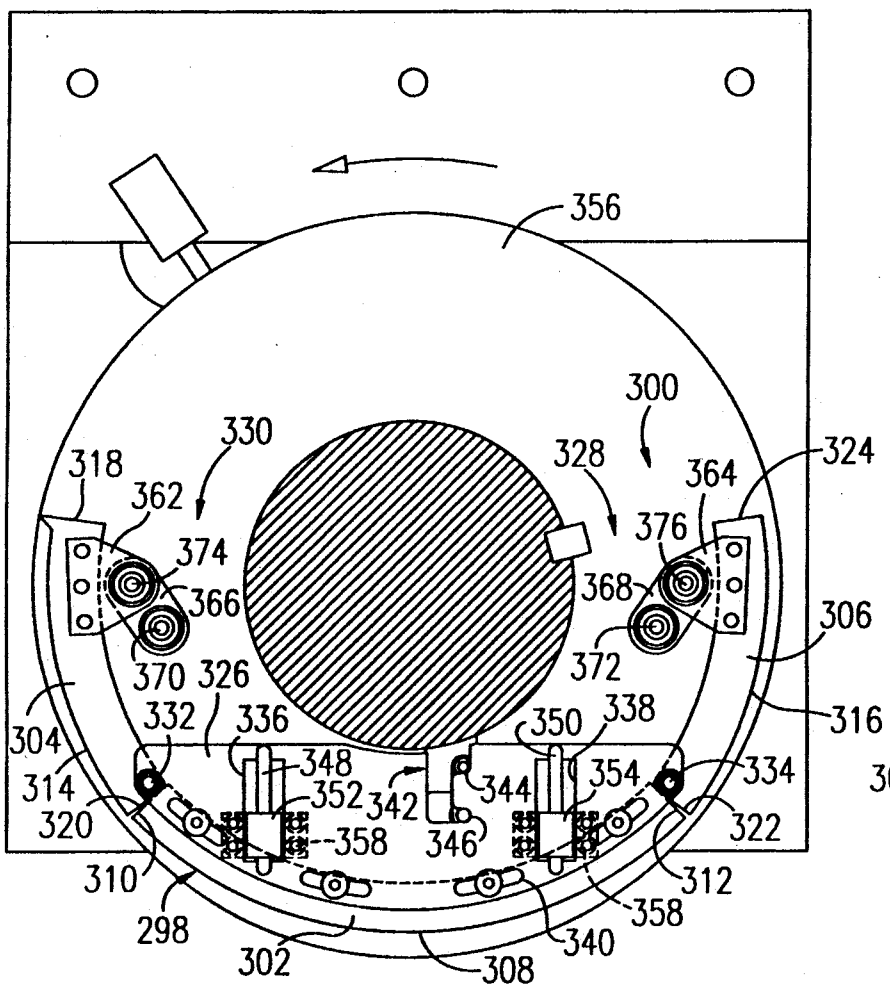
FIG. 28 is a sectional view of another slotter wheel apparatus in accordance with the invention, showing the blade in its fully retracted position.

Embodiment of FIGS. 28–29

An additional embodiment of the invention is depicted in FIGS. 28–29 which employs a multiple section, segmented cutting blade assembly 298 and shiftable blade coupling assembly 300. This arrangement replaces the keyway sets 50, keys 82, and shoulder bolt 83 components of coupling means 36 and shifting structure 38 described with reference to previous embodiments.

Blade assembly 298 includes an elongated arcuate central section 302, and a pair of shorter arcuate blades 304, 306 on either side thereof. Central blade section 302 includes an outermost cutting edge 308 and ends 310, 312. Side blade sections 304, 306 likewise include cutting edges 314, 316, and end sections 318, 320, 322, 324. The blade section 302 is provided with spaced, bored openings for receipt of cap screws.

Shiftable blade coupling assembly 300 includes generally sector shaped blade holder 326, blade holder retaining assembly 328, and control link assembly 330. Blade holder 326 is pivotally connected to the inboard ends of side blade sections 304, 306 by a pair of pivots 332, 334. Blade holder 326 includes much of the structure of blade holder 70, including a pair of guide slots 336, 338, blade mounting slots 340, irregular opening 342, and lobe regions 344, 346. In this embodiment, guide slots 336, 338 are longitudinally bridged by keys 348, 350.

Blade holder retaining assembly 328 includes a pair of channels 352, 354 with apertured, outwardly extending flanges, which channels extend outwardly through a portion of each guide slot and receive its associated key. The flange portions of channels 352, 354 extend below the surface of blade holder 326 and are coupled to wheel 356 by threaded fasteners 358. Control link assembly 330 includes a pair of shoulder sections 362, 364 respectively located adjacent the outer ends of the blade sections 304, 306. Each shoulder section 362, 364 is pivotally coupled with a link 366, 368. As shown, the generally triangular shoulder sections 362, 364 are secured at the base to the upper, inboard edges of respective side blade sections 304, 306 with the corners thereof extending inwardly. The generally oblong link members 366, 368 each include a pivot 370, 372 at one end, which is fixedly coupled with wheel 356. Each link member further includes an opposed pivot member 374, 376 coupled with the wheel-facing surface of the inwardly extending portion of the respective shoulder section 362, 364.

Operation of the wheel assembly is very similar to that previously described with respect to FIGS. 1-5. From the fully retracted position depicted in FIG. 28, the blade assembly 298 is cammed outwardly to the fully extended slotting position depicted in FIG. 29. As blade holder 326 is cammed outwardly, keys 348, 350 ride downwardly within channels 352, 354. Central blade section 302 is moved into an extended position, thus shifting pivots 332, 334 and pivotally connected side blade ends 320, 322 outwardly. This outward force causes links 366, 368 to rotate outwardly about fixed pivots 370, 372 to a radially extended position, thus forcing side blade outer ends 318, 324 into an outwardly extended position. Outwardly extending side blade sections 304, 306 rotate about pivots 332, 334 bringing side blade inner ends 320, 322 into contact with central blade ends 310, 312, to form a continuous extended arcuate blade edge.

Embodiment of FIGS. 30-36

FIGS. 30-36 illustrate apparatus 400 which is a another embodiment in accordance with the present invention. In general, apparatus 400 includes non-rotatable and rotatable components. The non-rotatable components include mounting plate 402 presenting arcuately-shaped, yoke portion 404, cam assembly 406, and air cylinder 408. The rotatable components include shaft 410, hub 412, flange 414, pull wheel 416, and cutting blade group 418.

FIG. 32 best illustrates mounting plate 402 having yoke portion 404, presenting inner cam surface 405 and cam assembly 406 presenting a generally arcuate configuration around the arc of yoke portion 404. Cam assembly 406 includes fixed cam portion 420 which is secured to the face of yoke portion 404 by screws 422, and arcuate shiftable cam portion 424 pivotally coupled with fixed portion 420 by pivot pin 428. Cam assembly 406 is configured to present a continuous cam slot or track 430 with fixed cam portion presenting fixed cam track 430*a* and with shiftable cam portion presenting shiftable cam track 430*b*. As illustrated in FIG. 32, the entrance to track 430*a* is defined by a high density polyethylene impact-absorbing insert 431 presenting a widened throat for guiding cam followers thereinto as explained below.

Air cylinder 408 is mounted to the face of mounting plate 402 and includes piston rod 432 extending generally rightwardly as shown in FIG. 32 with the distal end coupled with shiftable cam portion 424 for shifting thereof between extended and retracted positions as explained further hereinbelow.

Hub 412 is configured to fit around shaft 410 and fixed for rotatable movement therewith by key 434 which fits within keyways 436*a* and 436*b* defined respectively in shaft 410 and hub 412 as illustrated. While key 434 prevents relative circumferential shifting, hub 412 is configured for longitudinal shifting relative to shaft 410 in order to change the position of slots formed into carton blanks. The arcuate surface of yoke portion 404 is configured to conform generally with the upper peripheral surface of hub 412 as best shown in FIG. 32.

Outwardly extending flange 414 is coupled with hub 412 and is positioned adjacent yoke portion 404 on the inboard side thereof as best illustrated in FIG. 33. Pull wheel 416 is also coupled with hub 412 but spaced forwardly of flange 414 in front of yoke portion 404.

Figure 30:
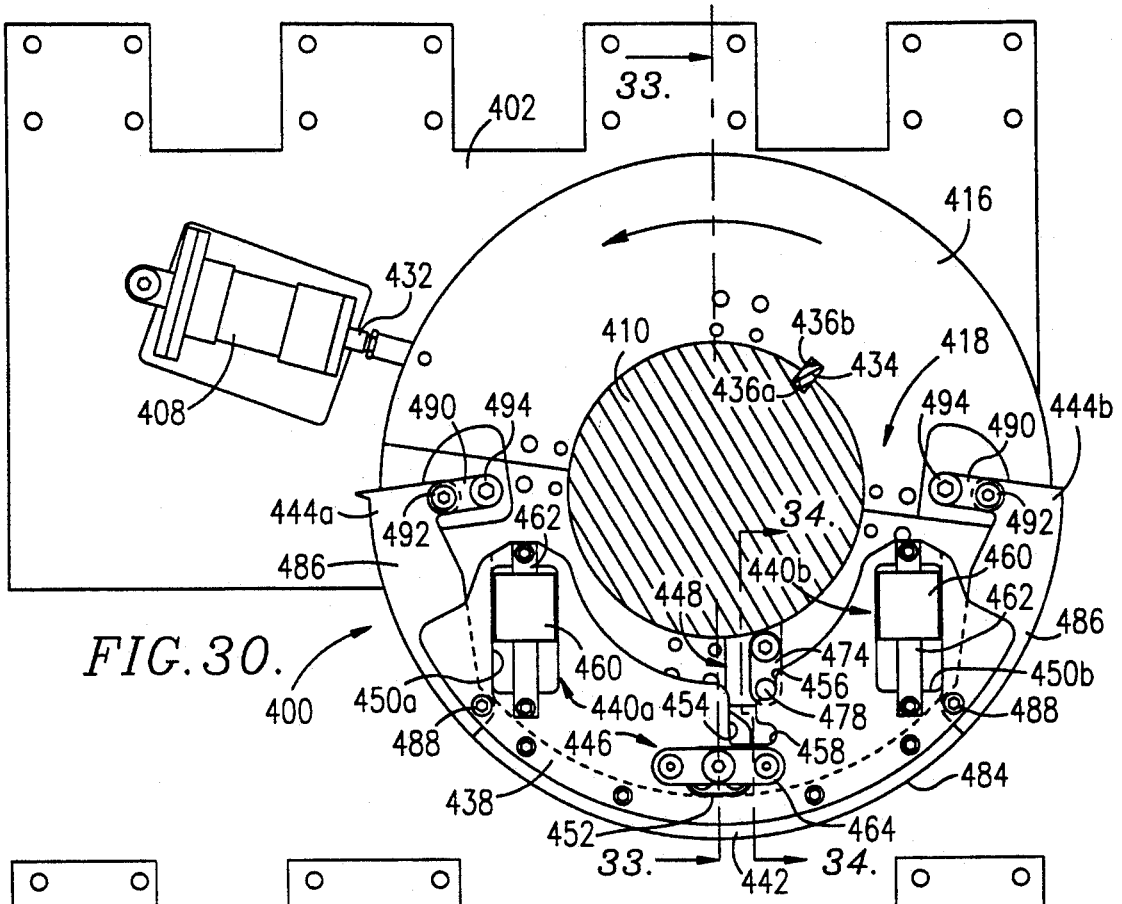
FIG. 30 is an elevational view of another slotter wheel apparatus in accordance with the invention shown in the extended position.
Figure 31:
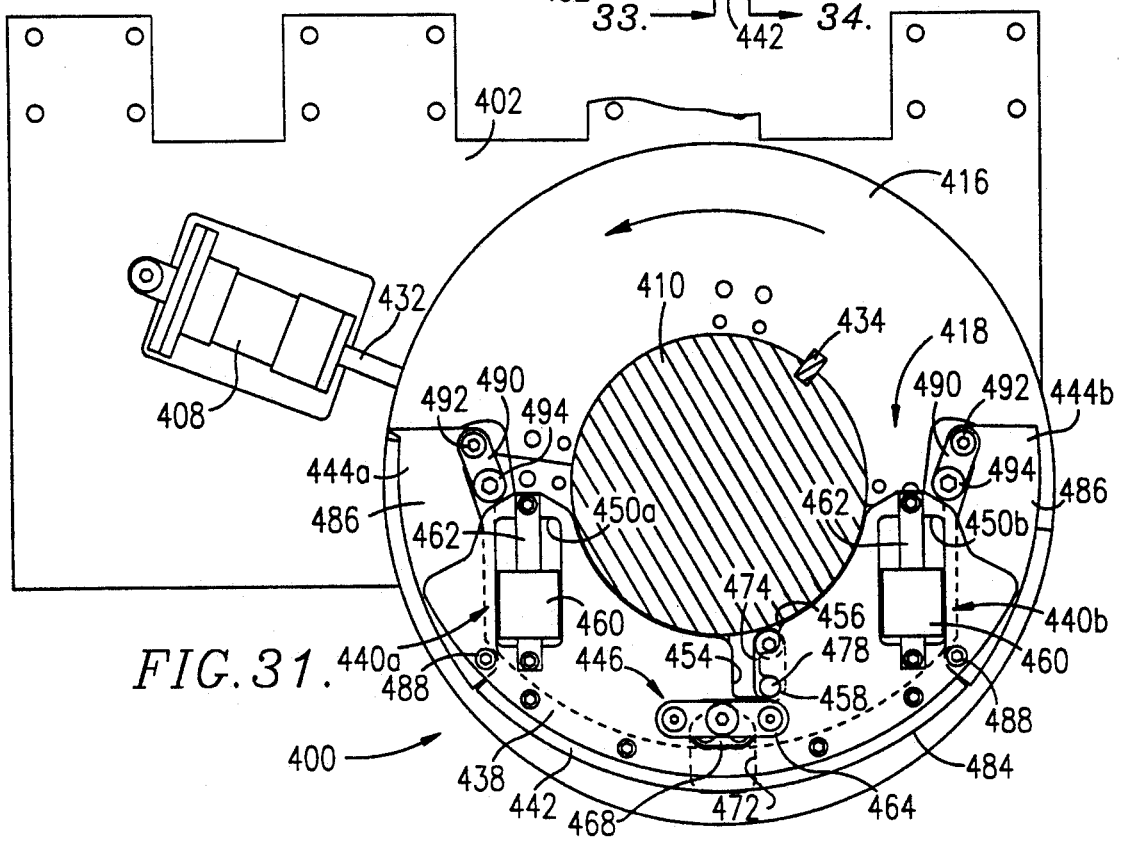
FIG. 31 is an elevational view of the slotter apparatus of FIG. 28 shown in the retracted position.

Cutting blade group 418 includes blade holder 438, left and right guide assemblies 440*a* and 440*b*, shiftable center blade 442, left and right swingable blades 444*a* and 444*b*, cam follower assembly 446, and locking link assembly 448. Blade holder 438 presents a generally arcuate configuration and includes left and right, rectangularly-shaped, guide openings 450*a* and 450*b*, centrally located, triangularly-shaped, cam follower opening 452, and locking link opening 454 presenting extended locking slot 456 and retracted locking slot 458 configured as illustrated in FIGS. 30 and 31.

Each guide assembly 440*a*, 440*b* includes a guide block 460 having a central aperture (not shown) defined therethrough and a guide rod 462 received through a corresponding guide block aperture. Each guide block 460 is received through a respective guide opening 450*a*, 450*b* and is fixedly secured to the outboard face of pull wheel 416. The respective ends of guide rods 462 are attached to blade holder 438 adjacent opposed ends of corresponding guide openings 450*a*, 450*b*. This arrangement mounts blade holder 438 to the outboard face of pull wheel 416 and allows blade holder 438 to shift radially for extending and retracting blades 442 and 444*a*, 444*b* as explained further hereinbelow.

Cam follower assembly 446 includes mounting link 464 secured to the outboard face of blade holder 438 and spanning the upper portion of cam follower opening 452, and further includes shoulder bolt 466 extending inwardly from the inboard side of mounting link 464 through opening 452. The follower support body is mounted to the distal end of shoulder bolt 466, and a pair of cam followers 470*a* and 470*b* extend inwardly from support body 468 through cam follower aperture 472 defined in pull wheel 416.

Locking link assembly 448 includes center link 474 having one end pivotally coupled with a recessed portion of hub 412, locking rod 478 extending outwardly from the distal end of link 474, cam surface follower 480 extending inwardly from the distal end of link 474, and helical spring 482 having one end coupled with central link 474 and having the other end coupled with hub 412 in the direction of the rotation thereof in order to bias assembly 448 to the position shown in FIG. 32.

Center blade 442 is centrally located and fixed to the inboard side of blade holder 438 with cutting edge 484 extending slightly therebeyond and conforming to the arcuate configuration of holder 438. Swingable blades 440*a* and 440*b* present mirror images of one another and each includes blade body 486, pivot pin 488, swing link 490, and link pins 492 and 494. Pivot pin 488 pivotally couples one end of blade body 486 to blade holder 438 adjacent a respective end of center blade 442. Link pin 492 pivotally couples one end of link 490 with the opposed end of blade body 486 adjacent the inboard side thereof. Link pin 494 pivotally couples the other end of link 490 with pull wheel 416 in a relieved area thereof. The provision of the swingable blades 440*a*, 440*b* allows presentation of a blade cutting arc of nearly 180° as illustrated in FIGS. 30 and 31.

In the operation of apparatus 400, blades 442 and 440*a*, 440*b* are selectively shiftable between an extended position as illustrated in FIG. 30 and a retracted position as illustrated in FIG. 31. In either position, locking link assembly 448 locks blade holder 438 thereby blades 442 and 444*a*, 444*b* in the selected position during rotation through the lower portion of rotation of the arc. For example, in the extended position of FIG. 30, locking rod 478 engages retracted locking slot 458 and is held therein under the bias of spring 482. In the retracted position of FIG. 31, locking rod 478 engages retracted locking slot 458 and holds cutting blade group 418 in the retracted position.

As components 410-418 continue to rotate (counterclockwise as illustrated in FIGS. 30–32), cam surface follower 480 engages inner cam surface 405 which, with continued rotation, pivots locking link assembly 448 so that locking rod 478 disengages from either of locking slots 456, 458. Simultaneously, cam followers 470*a*, 470*b* enter the widened throat of cam track 430*a* which begins to guide and shift blade holder 438 to an intermediate position.

During continued rotation, cam followers 470*a*, 470*b* continue to follow cam track 430 following first track 430*a* and then 430*b*, while cam surface follower 480 continues to follow inner cam surface 405 in order to maintain locking link assembly 448 in the unlocked or disengaged position.

Selective actuation of air cylinder 408 determines whether shiftable cam portion 424 is in its extended or retracted position. For example, as illustrated in FIG. 32, piston 432 is shifted rightwardly which also shifts cam portion 424 rightwardly. In this position, cam followers 470*a*, 470*b* present cutting blade group 418 in the retracted position. When cam surface follower 480 disengages from inner cam surface 405, the bias of spring 482 shifts locking link assembly 448 so that locking rod 478 engages extended locking slot 456. On the other hand, with cam portion 424 shifted leftwardly, the tracking of cam followers 470*a*, 470*b* through cam track 430*b* causes shifting of cutting blade group 418 to the extended position. Locking rod 478 then engages extended locking slot 456 which holds blade group 418 in the extended position during rotation through the bottom portion of the arc until cam surface follower 480 again engages inner cam surface 405 at the end of the bottom portion of the arc.

As those skilled in the art will appreciate the embodiment illustrated by apparatus 400 presents a number of advantages. For example, no matter what position is selected for the blades, they are locked in that position during rotation through the bottom of the arc. In this way, if the extended position is selected, the blades are locked in this position to ensure proper cutting of corrugated material. Additionally, apparatus 400 presents a mechanically reliable configuration for selecting the desired position.

Embodiment of FIGS. 37–43

This embodiment broadly includes a primary yoke plate 500, hub 502, fixed blade support plate 504, shiftable blade support plate 506, blade holder 508, cutting blade assembly 510, and blade shifting mechanism 512.

In more detail, the yoke plate 500 is in the form of a metallic plate 514 adapted to be secured within a box blank-forming machine, and includes a downwardly opening hub-supporting recess 516, the latter being defined by a pair of opposed, laterally spaced apart plate extensions 518, 520 each presenting an inboard engagement surface 522, 524. The plate 514 further includes a rectangular opening 526 therein adapted to receive a pneumatic cylinder later to be described. Additionally, the plate 500 is equipped with a pair of cam guide assemblies 528, 529 each including an aperture 530, 531 through the plate, as well as an elongated guide rod 532, 533 secured to the plate and extending across the corresponding aperture. A shiftable bearing 534, 535 is reciprocal along the length of the associated rod 532, 533.

Hub 502 is in the form of an annular body presenting a keyway 536 as well as opposed front and rear surfaces 538, 540. A series of threaded bores 542 are provided in the hub as shown. The hub is adapted to be secured, via key 544, to a central driven shaft 546.

Figure 38:
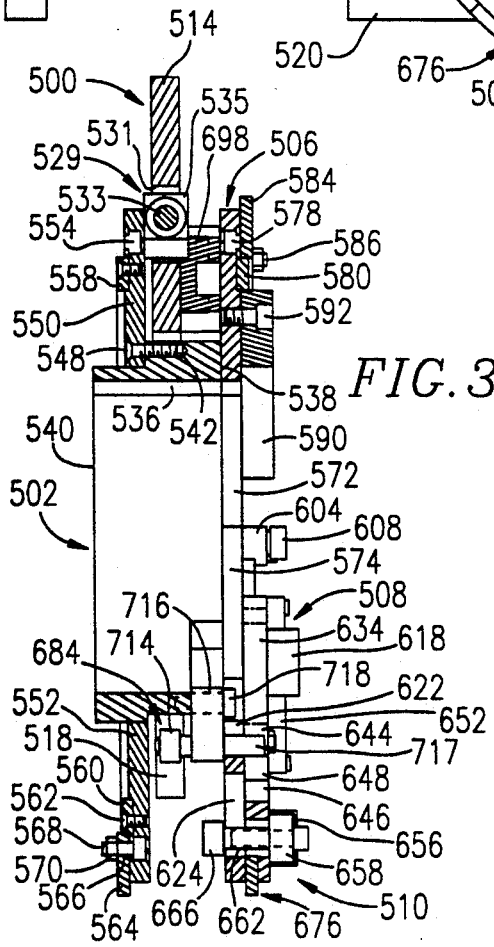
FIG. 38 is a sectional view taken along line 38—38 of FIG. 37.

The fixed blade supporting plate 504 is secured to hub 502 by means of screws 548 extending into the bores 542 (see FIG. 38). As best seen in FIG. 42, the support plate 504 is in the form of two semicircular sections 550, 552 which cooperatively define the complete, annularly-shaped plate disposed about hub 502. The rearmost surfaces of the plate-defining sections 550, 552 are provided with continuous, semicircular undercut slots 554, 556, as well as similarly configured, sectionalized retaining rings 558, 560 secured to a corresponding section by means of screws 562. The support plate 504 is designed to receive one or more fixed cutting blades 564. To this end, each blade 564 has a total of three spaced openings 566, therethrough, which are adapted to receive the shanks of attachment bolts 568. The heads of bolts 568 are in turn received within the undercut slots 554 or 556, with the associated retaining rings 558 and 560 serving to retain the bolts within the described undercut slots. Connection of the fixed blades 564 to the plate 504 is completed by means of nuts 570 affixed to the bolts 568 as shown. It will therefore be appreciated that the position of the fixed blades 564 can be changed through the expedient of loosening the nuts 570, shifting the blades as desired, and thereafter retightening the nuts.

The shiftable support 506 is likewise formed from a pair of semicircular sections 572, 574 which are secured to hub 502 by means of screws 576. The upper plate section 572 is equipped with a substantially semi-circular, undercut knife-supporting slot 578 similar to the slots 554, 556 described with reference to the fixed blade support plate 504. Additionally, a semicircular retainer 580, secured to the section 572 via screws 582, is located in partial overlapping relationship to the slot 578. A fixed cutting blade 584 may optionally be secured to the section 572 by means of bolts 586, the heads of which are located within the slot 578 and are retained therein by means of retainer 580. Nuts 588 affixed to the bolts 586 are used to complete the connection of fixed blade 584 to section 572. Again, the position of this blade 584 may be readily altered by loosening the nuts 588, shifting the plate and its supporting bolts 586, and retightening the nuts.

The upper plate section 572 is also equipped with a counter weight 590 of arcuate configuration which is attached by means of screws 592. The lowermost ends of the section 572 are also provided with shaped recesses 594, 596.

Lower plate section 574 includes, adjacent the upper ends thereof abutting section 572, recesses 598, 600 which mate with the recesses 594, 596 of section 572, thereby forming a pair of joinder recesses. A pivotal link 602, 604 is secured within each of the described recesses by means of threaded attachments 606, 608. Additionally, a pair of elongated phosphor-bronze bearing pads 610, 612 are affixed to the section 574 beneath each recessed region.

Figure 41:
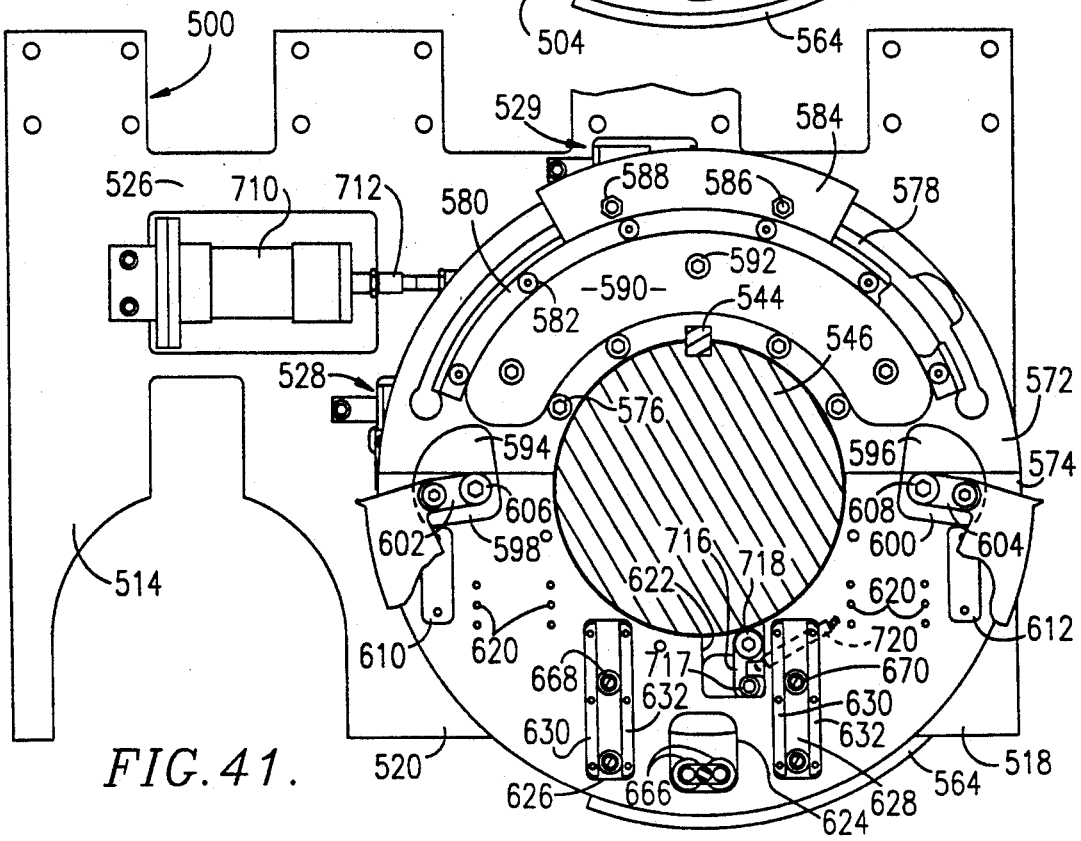
FIG. 41 is a view similar to that of FIG. 37, but illustrating the blade and blade holder removed to depict the blade guide mechanism.

A pair of slide blocks 614, 616 are secured to section 574 by means of screws 618 received within appropriately located threaded bores 620 in the face of section 574. Referring specifically to FIG. 41, it will be observed that the plate 574 has an upwardly opening recess 622 adjacent hub 502 and shaft 546, as well as a lower, substantially centrally located opening 624 therethrough. Furthermore, the plate section 572 has a pair of upright guides 626, 628 respectively located on opposite sides of the opening 624. Each of the guides 626, 628, includes a pair of spaced guide walls 630, 632 secured to the face of section 574.

Figure 37:
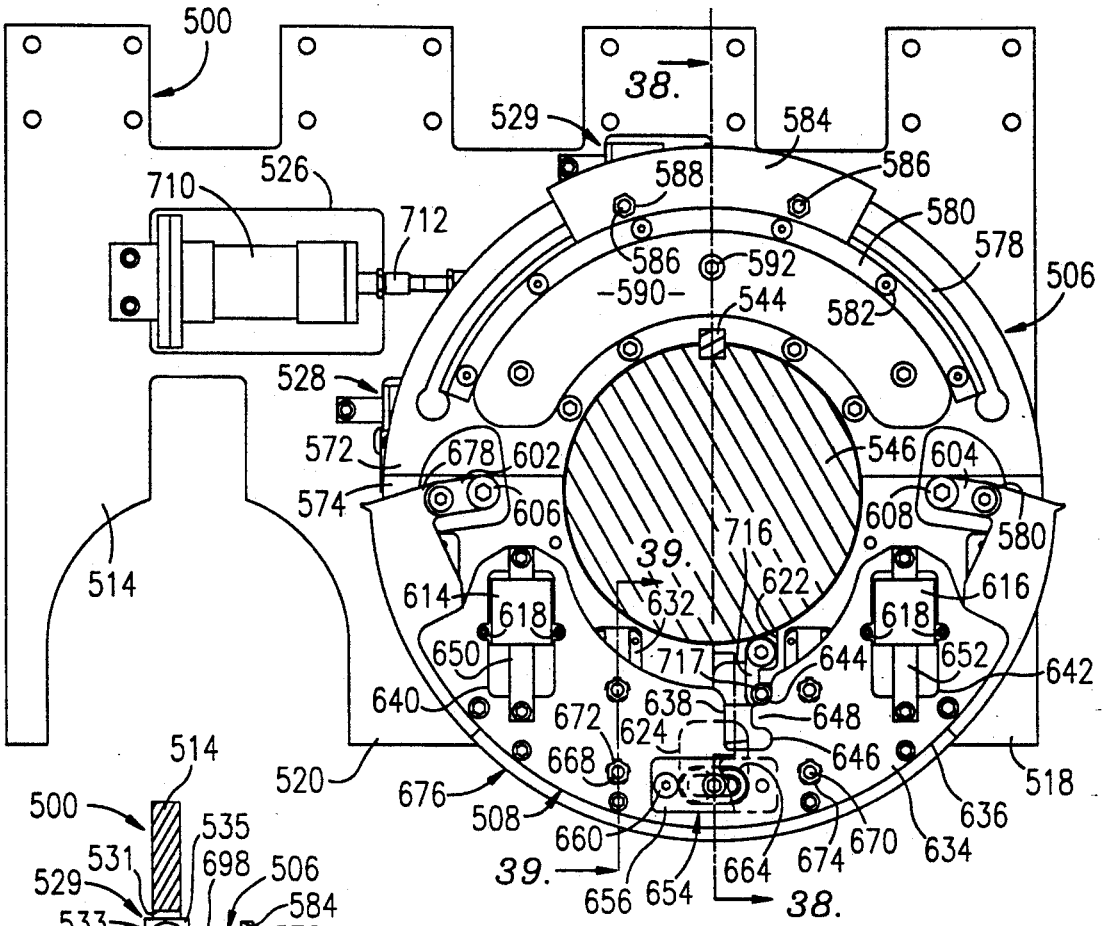
FIG. 37 is a side elevational view of another slotter wheel apparatus in accordance with the invention.
Figure 39:
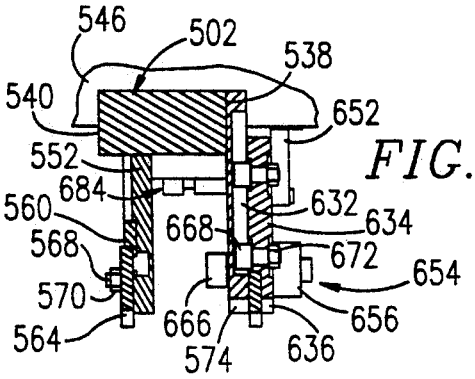
FIG. 39 is a fragmentary sectional view taken along line 39—39 of FIG. 37.

Blade holder 508 is best illustrated in FIGS. 37–39 and is in the form of an irregularly-shaped but generally arcuate plate 634 presenting an outermost, smoothly arcuate surface 636, an inboard irregular recess 638 and a pair of guide openings 640, 642. The recess 638 presents an inner blade extension notch 644, an outer blade retraction notch 646, with a land 648 therebetween. The openings 640, 642 are equipped with elongated guide rods 650, 652 extending along the lengths thereof and respectively received within a corresponding slide block 614 or 616.

A follower assembly 654 is secured to the plate 634 and includes an outermost, apertured member 656 which supports a central bearing 658 and is secured to the plate 634 by means of screws 660 (see FIG. 43). The bearing 658 in turn supports an enlarged rotatable shank 662 which extends through an oval-shaped opening 664 provided in plate 634 in registry with opening 624. A pair of follower rollers 666 are secured to shank 662 and are located just inboard of plate section 574.

The plate 634 is guided for reciprocal in and out movement thereof by means of two pairs of guide bolts 668, 670 which are affixed to the plate 634 by nuts 672, 674. The enlarged heads of the bolts 668, 670 are located to slide within the guides 626, 628 previously described.

The blade holder 508 supports an arcuate, sectionalized, pivotally interconnected cutting blade 676 which is identical to the cutting blade described in connection with the embodiment of FIGS. 30 and 31. The blade 676 presents, adjacent the extreme ends thereof, ears 678, 680; the links 602, 604 are secured to these ears as best seen in FIG. 37. These links, and the associated recesses, accommodate extension and retraction of the blade 676 with blade holder 508 as will be described.

Figure 40:
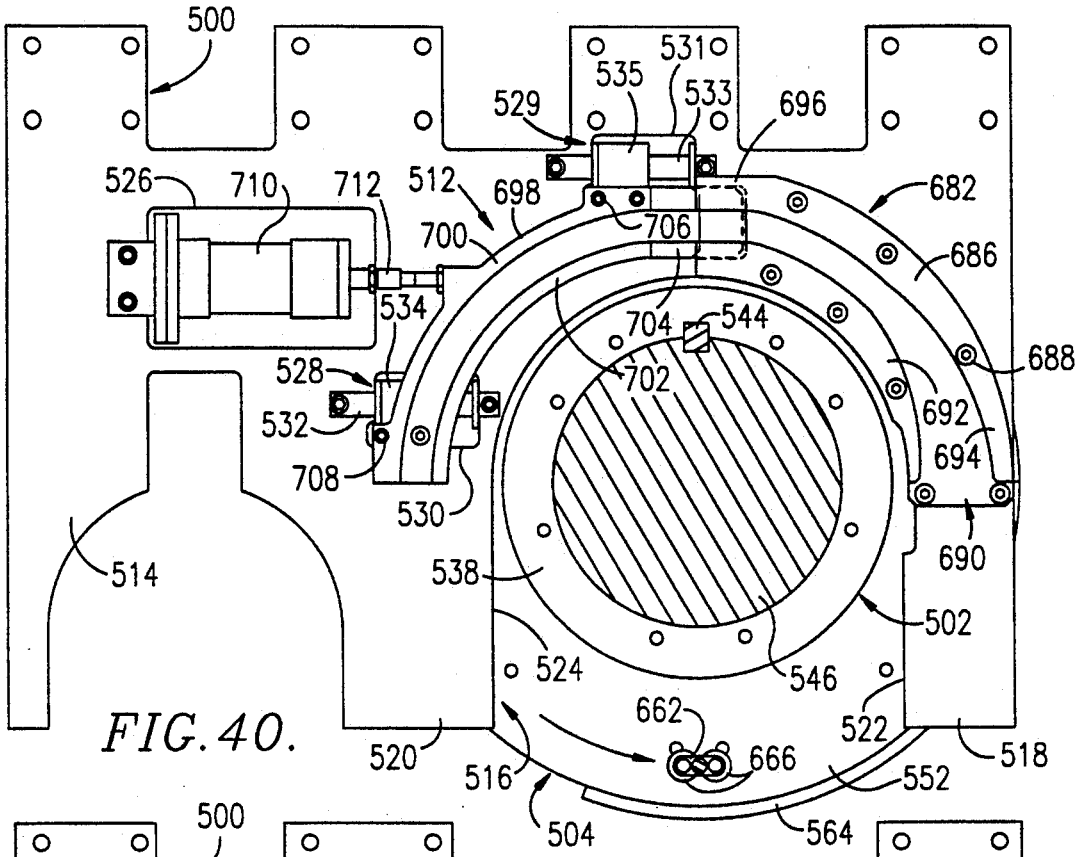
FIG. 40 is a view similar to that of FIG. 37, with the blade and blade holder apparatus removed to illustrate the structure therebehind.

The blade shifting mechanism 512 broadly includes a cam track assembly 682, and cooperating cam follower 684. The assembly 682 includes a fixed cam track section 686 formed of high density polyethylene material and secured to plate 514 by means of screw 688. As best seen in FIG. 40, the fixed section 686 presents a relatively wide entrance mouth 690 as well as a pair of track-defining side segments 692, 694. The upper end of section 686 presents a pair of tongues 696 as best seen in FIG. 43. The overall cam track assembly 682 further includes a shiftable cam track section 698 having a pair of spaced apart, track-defining sidewalls 700, 702. The upper end of track section 698 slidably interfits with the fixed section 682, and to this end is provided with corresponding grooves 704 adapted to receive tongues 696.

The guide bearings 534, 535 are secured to section 698 by means of screws 706, 708, so as to guide section 698 for rectilinear movement thereof. The section 698 is selectively movable between an inner, blade retraction position and an outer, blade extension position by means of a pneumatic piston and cylinder assembly 710 situated within plate opening 526. The assembly 710 includes a shiftable rod 712 affixed to section 698 intermediate the ends thereof.

The cam follower 684 includes an annular roller 714 supported on hub 502 via link 716 and pin 717, the link 716 being pivotally coupled to hub 502 by means of pivot screw 718. A small spring 720 interconnects the link 716 and hub 502, for biasing link 716 rightwardly as viewed in FIG. 41. The pin 717 extends forwardly from link 716 through recess 622 and is sized to alternately interfit with the notches 644, 646 of plate 634.

In the operation of this embodiment, shaft 546 is rotated in a counterclockwise direction, and blade 676 may be constantly retracted, constantly extended, or alternately extended and retracted. Considering first the operation when the blade 676 is constantly retracted, the assembly 710 is operated to extend rod 712 and thereby shift cam track section 698 rightwardly as viewed in FIG. 40. In this orientation, rotation of the shaft 546 first causes roller 714 to contact engagement surface 522 and thence follow the inner surface of plate 514 defining recess 516. During the time that roller 714 is in engagement with the recess-defining surface of plate 514, the pin 717 is shifted into an intermediate position in engagement with land 648 between the notches 644, 646. Rotation of shaft 546 also causes the follower rollers 666 to enter mouth 690 of stationary cam track section 686, and to follow the track thereof along the length of the section 686 until it enters the track of movable section 698. Inasmuch as the latter is in the rightwardly shifted (FIG. 40) blade retraction position, the follower rollers 666 conform with this position and this serves to maintain the inward orientation of blade support plate 634. When the follower rollers leave the exit end of cam track section 698 and roller 714 comes out of contact with engagement surface 524, the spring 720 serves to pull pin 717 into blade retraction notch 646. As will be appreciated, this blade retracted operation continues until assembly 710 is actuated to move section 698 leftwardly to the full line position illustrated in FIG. 40.

When the track section 698 is moved leftwardly as viewed in FIG. 40, operation of the assembly proceeds in exactly the same manner as previously described, except that traversal of the track section 698 by the follower rollers 666 serves to move plate 634 outwardly (such being guided by the bolts 668, 670 and the slide blocks 614, 616). Thereafter, when roller 714 comes out of contact with surface 524, the pin 717 moves under the influence of spring 720 into blade extension notch 644. The blade 676 is thus maintained in its extended, cutting position during passage of the blade between the surfaces 524 and 522. It will also be observed that the described tongue and groove interconnection between the cam track sections 686 and 698 insures that the cam tracks of each section remain in continuous communication even when the section 698 is in its leftwardly shifted blade extension position (see FIG. 43). Accordingly, smooth tracking of the follower rollers 666 within the cam track is maintained in all cam track positions.

Alternate operation is of course accomplished through the simple expedient of operating assembly 710 to effect either retraction or extension of blade 676 during rotation of the entire unit as desired.

This embodiment also permits utilization of a fixed blade 584 in association with shiftable blade 676, which can be necessary in some box blank-forming operations. In addition, this embodiment can be used in a completely conventional fashion simply by removing the fixed blade 584, maintaining blade 676 in its retracted position, and installing one or more fixed blades 564 to the fixed blade support plate 504. Accordingly, this embodiment gives the maximum in operational flexibility coupled with provision of apparatus for shifting of the blade 676 during rotation between extended and retracted positions.

I claim:

1. Slotter wheel apparatus for slotting of box blanks at selectively variable locations along the length of the blanks as the blanks are sequentially advanced along a path of travel, said apparatus comprising:

a rotatable body presenting an axial length and a peripheral margin;

motor means operable coupled with said body for rotating said body at a rotational speed;

at least one slotter blade presenting an elongated cutting edge oriented substantially perpendicular to said axial length of said body;

means operably coupling said blade with said body and including structure for selectively shifting of said blade during rotation of said body between an extended slotting position wherein the blade cutting edge is located outboard of said body peripheral margin for slotting of said blank, and a retracted, blank-clearing position wherein said blade cutting edge will pass said blank without slotting thereof;

rotatable anvil means adjacent said rotatable body and operable with the rotatable body to define a region therebetween for receiving the box blank as the box blanks are sequentially advanced along said path of travel, said anvil means presenting an opening for reception of said slotter blade when the slotter blade is moved from said retracted position thereof to said extended position thereof, said blade-shifting structure including control means for selectively varying the instances when said blade is moved from said retracted position to said extended position thereof during rotation of said body without the need for stopping the rotation of said body; and means for locking said blade in said extended and retracted positions thereof.

2. Apparatus as set forth in claim 1, said blade-shifting structure having means for shifting of said blade in order to place the blade in said extended position during alternating revolutions of said body.

3. Apparatus as set forth in claim 1, said blade-shifting structure including:

a blade holder;

means releasably securing said blade to said blade holder;

means shiftably coupling said blade holder to said body including structure defining a pair of stationary cam grooves respectively oriented for holding said blade in said extended and retracted positions thereof, and a cam follower operatively attached to said blade holder and alternately receivable within said cam grooves, there being means for selectively directing said cam follower into either of said cam grooves during rotation of said body.

4. Apparatus as set forth in claim 4, said cam follower-directing means including a shiftable switch element presenting a cam groove therein, and means mounting said element proximal to said pair of stationary cam grooves for directing said cam follower into one or the other of said stationary cam grooves.

5. Apparatus as set forth in claim 4, including a stationary plate mounted adjacent said body and supporting said cam grooves, said switch element being operatively secured to said plate.

6. Apparatus as set forth in claim 1, said locking means comprising a locking pin carried by said body, a blade holder shiftably secured to said body and supporting said slotter blade, said blade holder being configured to present an opening therein having a pair of pin-receiving terminal regions, said locking pin being received within said opening and being selectively and alternately engageable with said terminal regions for locking said blade in said extended and retracted positions thereof.

7. Apparatus as set forth in claim 6, including biasing means operably coupled with said locking pin for urging the pin into said terminal regions.

8. Apparatus as set forth in claim 1, said slotter blade being a unitary member of arcuate configuration and presenting an outermost, blank-engaging edge.

9. Apparatus as set forth in claim 1, said slotter blade comprising a pair of blade sections, and means interconnecting said sections for movement thereof between a folded-together retracted position and an extended position.

10. Apparatus as set forth in claim 1, said blade cutting edge being inboard of said peripheral margin in the retracted position of the blade.

11. Apparatus as set forth in claim 1, said blade-shifting structure including:

a blade holder;

means securing said blade to said blade holder; and means shiftably coupling said blade holder to said body including structure defining a cam track having an inlet end, and having an outlet end which is selectively shiftable between blade extended and blade retracted positions, and a cam follower attached to said blade holder for reception in said track for shifting said holder to one of said positions in accordance with the position of said track outlet end.

12. Apparatus as set forth in claim 11, said locking means including means for disengagement thereof during passage of said cam follower through said cam track.

13. Apparatus as set forth in claim 11, said cam track including a stationary cam track section and a shiftable cam track section, there being means for selectively shifting said shiftable cam track section between said blade extended and blade retracted positions thereof.

14. Apparatus as set forth in claim 13, said cam track shifting means including structure for pivotal movement of said shiftable cam track section.

15. Apparatus as set forth in claim 13, said cam track shifting means including structure for rectilinear movement of said shiftable cam track section.

16. Apparatus as set forth in claim 15, including tongue and groove interconnection means between said stationary and shiftable cam track sections.

* * * * *